US011491787B2

(12) United States Patent
Ai et al.

(10) Patent No.: US 11,491,787 B2
(45) Date of Patent: Nov. 8, 2022

(54) HEAD CHIP, LIQUID JET HEAD, AND LIQUID JET RECORDING DEVICE

(71) Applicant: SII PRINTEK INC., Chiba (JP)

(72) Inventors: Tomoki Ai, Chiba (JP); Yuki Yamamura, Chiba (JP); Masakazu Hirata, Chiba (JP); Kenji Suzuki, Chiba (JP)

(73) Assignee: SII PRINTEK INC., Chiba (JP)

( * ) Notice: Subject to any disclaimer, the term of this patent is extended or adjusted under 35 U.S.C. 154(b) by 4 days.

(21) Appl. No.: 17/102,723

(22) Filed: Nov. 24, 2020

(65) Prior Publication Data

US 2021/0162754 A1 Jun. 3, 2021

(30) Foreign Application Priority Data

Nov. 28, 2019 (JP) ..... JP2019-215364

(51) Int. Cl.
*B41J 2/14* (2006.01)
*B41J 2/155* (2006.01)

(52) U.S. Cl.
CPC ..... *B41J 2/1433* (2013.01); *B41J 2/155* (2013.01); *B41J 2002/14411* (2013.01)

(58) Field of Classification Search
CPC ..... B41J 2/1433; B41J 2002/14411
See application file for complete search history.

(56) References Cited

U.S. PATENT DOCUMENTS

2015/0029271 A1* 1/2015 Domae ..... B41J 2/1642 29/25.35
2015/0145927 A1* 5/2015 Murochi ..... B41J 2/14209 347/68

FOREIGN PATENT DOCUMENTS

EP 2363291 A1 9/2011
JP 2004-174857 A 6/2004

OTHER PUBLICATIONS

Extended European Search Report in Europe Application No. 20210387.5, dated Mar. 26, 2021, 8 pages.

* cited by examiner

*Primary Examiner* — Jason S Uhlenhake
(74) *Attorney, Agent, or Firm* — Crowell & Moring LLP

(57) ABSTRACT

There are provided a head chip and so on capable of improving the print image quality. The head chip according to an embodiment of the present disclosure is provided with an actuator plate having a plurality of ejection grooves and a nozzle plate having a plurality of nozzle holes individually communicated with the plurality of ejection grooves. The plurality of ejection grooves is arranged side by side so as to at least partially overlap each other along a predetermined direction. Further, the nozzle holes adjacent to each other along the predetermined direction out of the plurality of nozzle holes are arranged so as to be shifted from each other along an extending direction of the ejection grooves in the nozzle plate.

8 Claims, 12 Drawing Sheets

COMPARATIVE EXAMPLE

COMPARATIVE EXAMPLE

MODIFIED EXAMPLE 1

MODIFIED EXAMPLE 1

MODIFIED EXAMPLE 1

HEAD CHIP, LIQUID JET HEAD, AND LIQUID JET RECORDING DEVICE

RELATED APPLICATIONS

This application claims priority to Japanese Patent Application No. 2019-215364, filed on Nov. 28, 2019, the entire content of which is incorporated herein by reference.

BACKGROUND OF THE INVENTION

1. Field of the Invention

The present disclosure relates to a head chip, a liquid jet head and a liquid jet recording device.

2. Description of the Related Art

Liquid jet recording devices equipped with liquid jet heads are used in a variety of fields, and a variety of types of liquid jet heads have been developed (see, e.g., JP-A-2004-174857).

Further, such a liquid jet head is provided with a head chip for jetting ink (liquid).

In such a head chip or the like, in general, it is required to improve print image quality. It is desirable to provide a head chip, a liquid jet head, and a liquid jet recording device capable of improving the print image quality.

SUMMARY OF THE INVENTION

The head chip according to an embodiment of the present disclosure is provided with an actuator plate having a plurality of ejection grooves, and a nozzle plate having a plurality of nozzle holes individually communicated with the plurality of ejection grooves. The plurality of ejection grooves is arranged side by side so as to at least partially overlap each other along a predetermined direction. Further, the nozzle holes adjacent to each other along the predetermined direction out of the plurality of nozzle holes are arranged so as to be shifted from each other along an extending direction of the ejection grooves in the nozzle plate.

The liquid jet head according to an embodiment of the present disclosure includes the head chip according to the embodiment of the present disclosure.

The liquid jet recording device according to an embodiment of the present disclosure includes the liquid jet head according to the embodiment of the present disclosure.

According to the head chip, the liquid jet head, and the liquid jet recording device according to an embodiment of the present disclosure, it becomes possible to improve the print image quality.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example of a configuration in which nozzle holes are in a staggered arrangement, and ejection grooves are in an in-tine arrangement)
2. Modified Examples Modified Example 1 (an example of a configuration in which a flow channel width of a common flow channel varies in accordance with an opening length of a through hole)

Modified Example 2((an example of a configuration in which both of nozzle holes and ejection grooves are in a staggered arrangement)

3. Other Modified Examples

1. Embodiment

[A. Overall Configuration of Printer 1]

Figure 1:
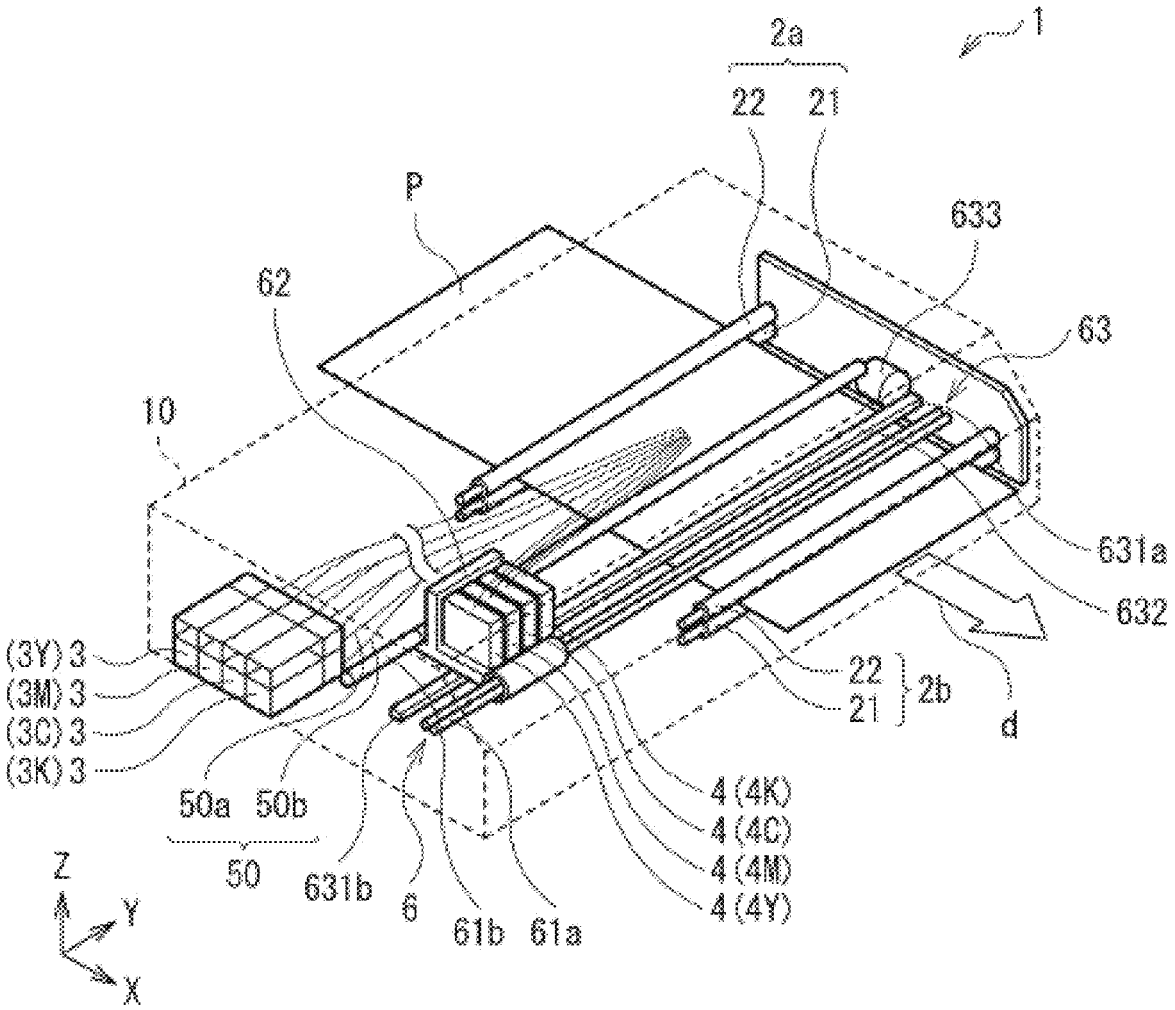
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink 9 described later. It should be noted that the recording target medium is not limited to paper, but includes a material on which recording can be performed such as ceramic or glass.

As shown in FIG. 1, the printer 1 is provided with a pair of carrying mechanisms 2*a*, 2*b*, ink tanks 3, inkjet heads 4, circulation channels 50, and a scanning mechanism 6. These members are housed in a chassis 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4K described later) each correspond to a specific example of a "liquid jet head" in the present disclosure. Further, the ink 9 corresponds to a specific example of the "liquid" in the present disclosure.

The carrying mechanisms 2*a*, 2*b* are each a mechanism for carrying the recording paper P along a carrying direction d (an X-axis direction) as shown in FIG. 1. These carrying mechanisms 2*a*, 2*b* each have a grit roller 21, a pinch roller 22, and a drive mechanism (not shown). This drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are provided four types of tanks for individually containing four colors of ink 9, namely yellow (Y), magenta (M), cyan (C), and black (K), in this example as shown in FIG. 1. Specifically, there are disposed the ink tank 3Y for containing the ink 9 having a yellow color, the ink tank 3M for containing the ink 9 having a magenta color, the ink tank 3C for containing the ink 9 having a cyan color, and the ink tank 3K for containing the ink 9 having a black color. These ink tanks 3Y, 3M, 3C, and 3K are arranged side by side along the X-axis direction inside the chassis 10.

It should be noted that the ink tanks 3Y, 3M, 3C, and 3K have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording (printing) of images, characters, and so on. As the inkjet heads 4, there are also disposed four types of heads for individually jetting the four colors of ink 9 respectively contained in the ink tanks 3Y, 3M, 3C, and 3K described above in this example as shown in FIG. 1. Specifically, there are disposed the inkjet head 4Y for jetting the ink 9 having a yellow color, the inkjet head 4M for jetting the ink 9 having a magenta color, the inkjet head 4C for jetting the ink 9 having a cyan color, and the inkjet head 4K for jetting the ink 9 having a black color. These inkjet heads 4Y, 4M, 4C and 4K are arranged side by side along the Y-axis direction inside the chassis 10.

It should be noted that the inkjet heads 4Y, 4M, 4C and 4K have the same configuration except the color of the ink 9 used therein, and are therefore collectively referred to as inkjet heads 4 in the following description. Further, the detailed configuration example of the inkjet heads 4 will be described later (FIG. 2 through FIG. 6).

(Circulation Flow Channels 50)

As shown in FIG. 1, the circulation channels 50 each have flow channels 50*a*, 50*b*. The flow channel 50*a* is a flow channel of a part extending from the ink tank 3 to the inkjet head 4 via a liquid feeding pump (not shown). The flow channel 50*b* is a flow channel of a part extending from the inkjet head 4 to the ink tank 3 via the liquid feeding pump (not shown). In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3.

In such a manner, in the present embodiment, it is arranged that the ink 9 is circulated between the inside of the ink tank 3 and the inside of the inkjet head 4. It should be noted that these flow channels 50*a*, 50*b* (supply tubes of the ink 9) are each formed of, for example, a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction.

The drive mechanism 63 has a pair of pulleys 631*a*, 631*b* disposed between the guide rails 61*a*, 61*b*, an endless belt 632 wound between these pulleys 631*a*, 631*b*, and a drive motor 633 for rotationally driving the pulley 631*a*. Further, on the carriage 62, there are arranged the four types of inkjet heads 4Y, 4M, 4C and 4K described above side by side along the Y-axis direction.

It is arranged that such a scanning mechanism 6 and the carrying mechanisms 2*a*, 2*b* described above constitute a moving mechanism for moving the inkjet heads 4 and the recording paper P relatively to each other. It should be noted that the moving mechanism of such a method is not a limitation, and it is also possible to adopt, for example, a method (a so-called "single-pass method") of moving only the recording target medium (the recording paper P) while fixing the inkjet heads 4 to thereby move the inkjet heads 4 and the recording target medium relatively to each other.

[B. Detailed Configuration of Inkjet Heads 4]

Subsequently, the detailed configuration example of the inkjet heads 4 (head chips 41) will be described with reference to FIG. 2 through FIG. 6, in addition to FIG. 1.

Figure 2:
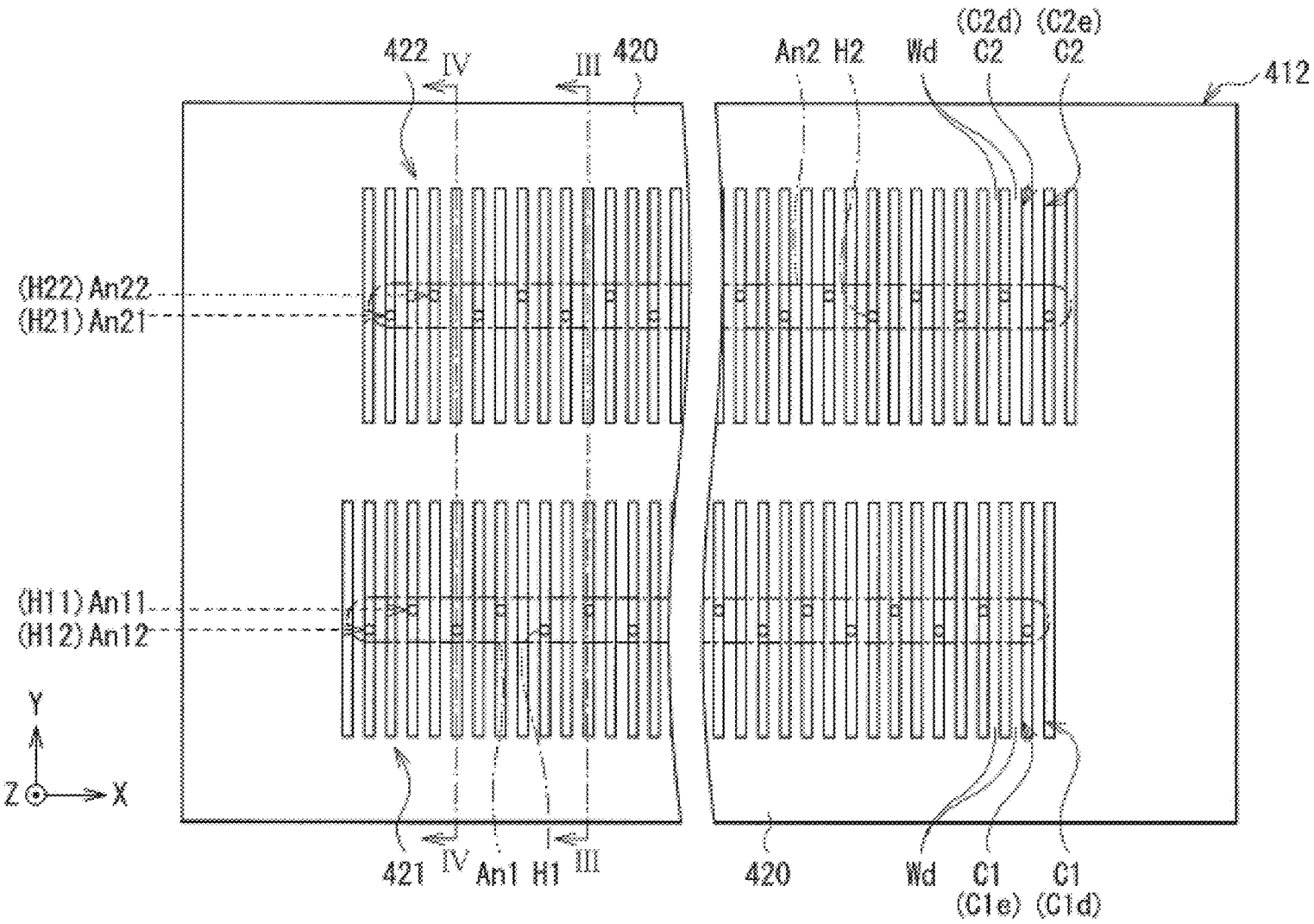
FIG. 2 is a schematic bottom view showing a configuration example of a liquid jet head in the state in which a nozzle plate is detached.
Figure 3:
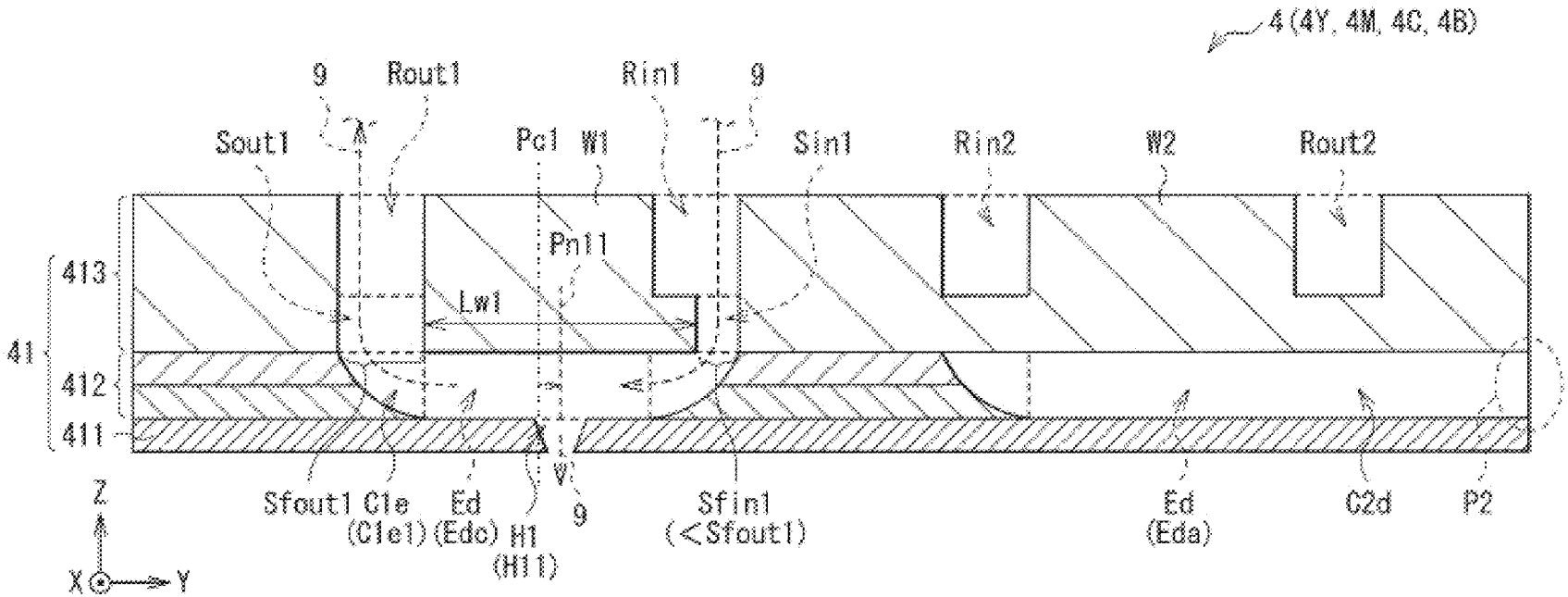
FIG. 3 is a schematic diagram showing a cross-sectional configuration example along the line III-III shown in FIG. 2.
Figure 4:
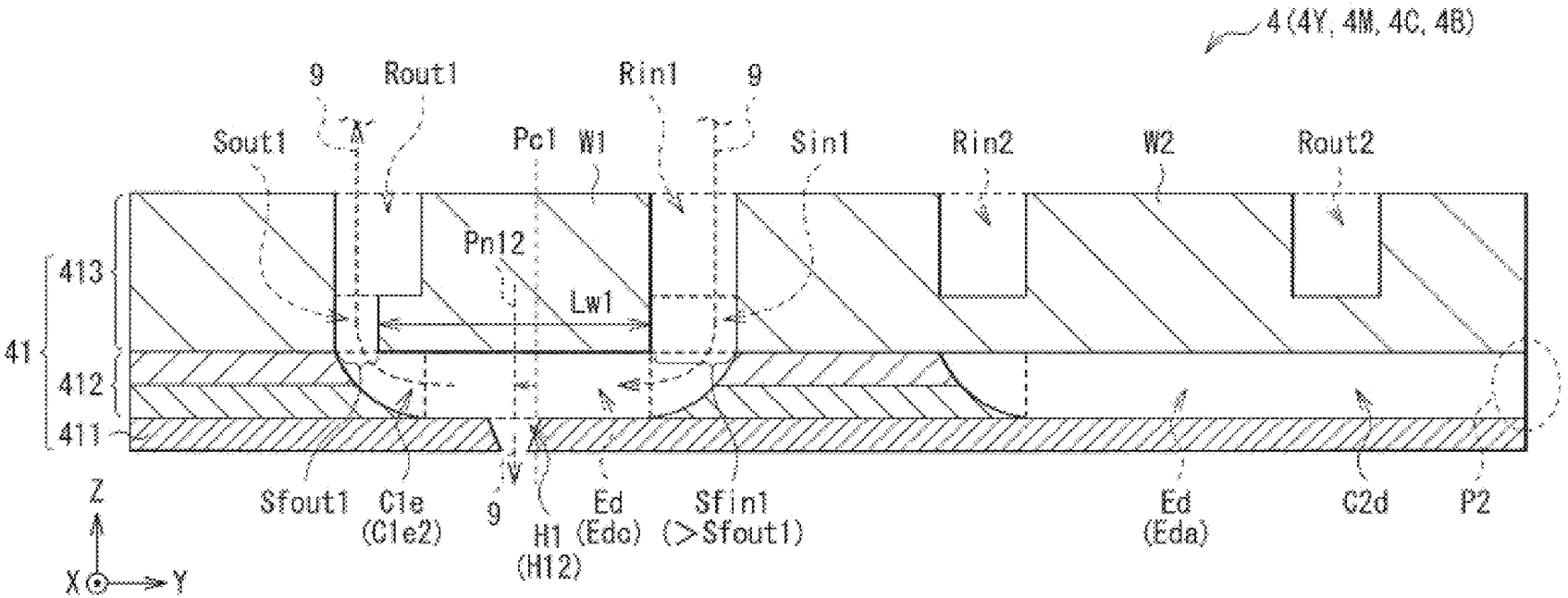
FIG. 4 is a schematic diagram showing a cross-sectional configuration example along the line IV-IV shown in FIG. 2.
Figure 5:
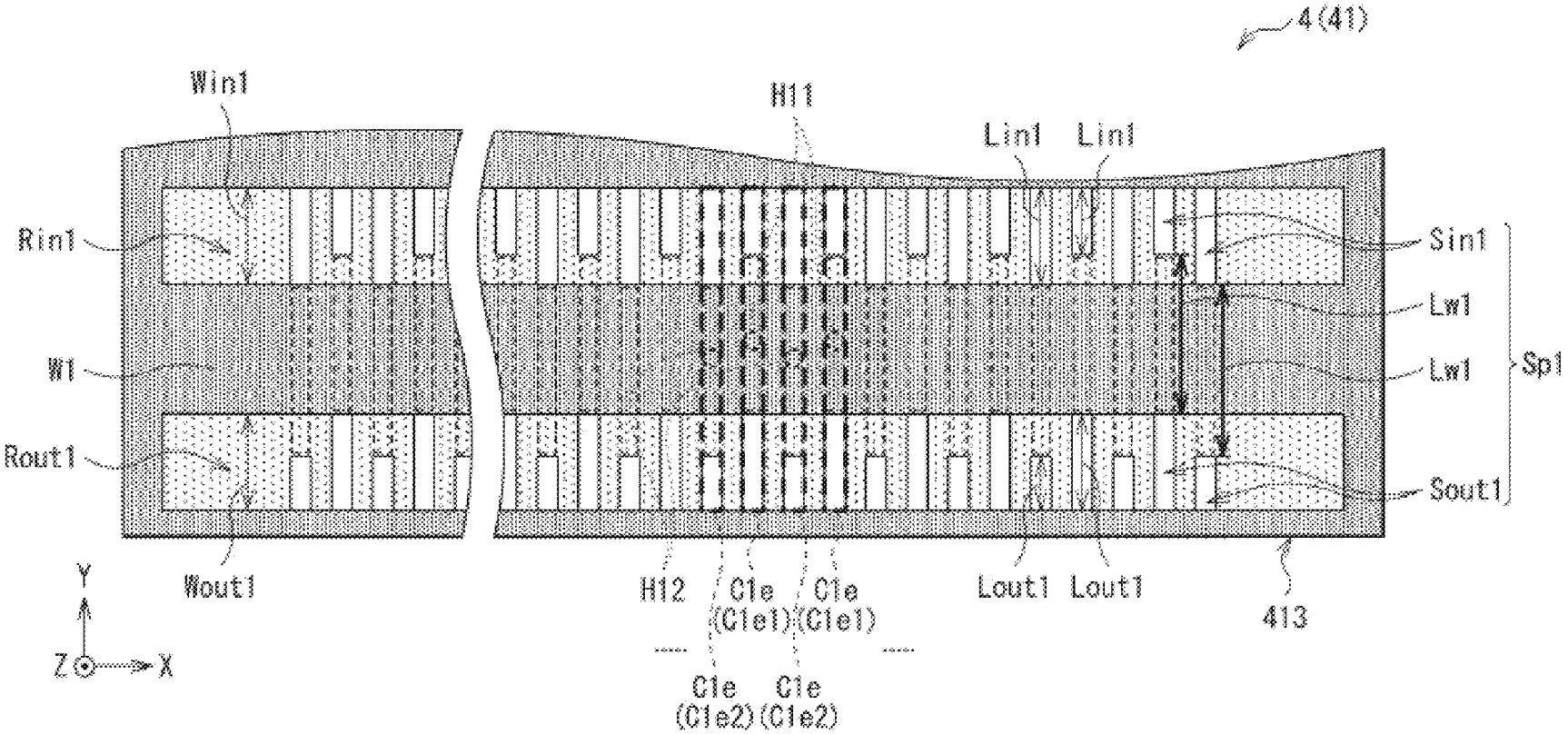
FIG. 5 is a schematic diagram showing a planar configuration example of the liquid jet head on the upper surface side of a cover plate shown in FIG. 3 and FIG. 4.
Figure 6:
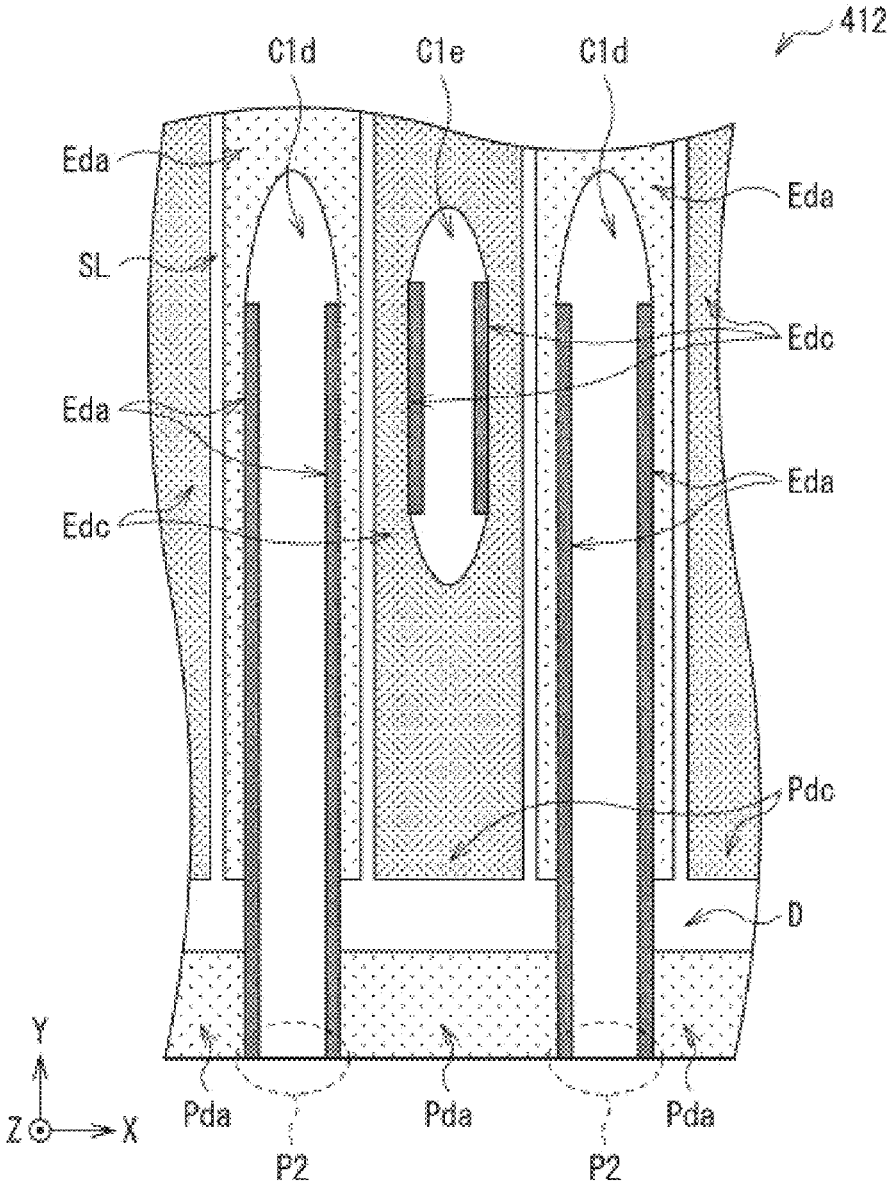
FIG. 6 is a perspective view showing a planar configuration example in a vicinity of an end part of an actuator plate shown in FIG. 3 and FIG. 4.

FIG. 2 is a diagram schematically showing a bottom view (an X-Y bottom view) of a configuration example of the inkjet head 4 in the state in which a nozzle plate 411 (described later) is detached. FIG. 3 is a diagram schematically showing a cross-sectional configuration example (a Y-Z cross-sectional configuration example) of the inkjet head 4 along the line III-III shown in FIG. 2. Similarly, FIG. 4 is a diagram schematically showing a cross-sectional configuration example (a Y-Z cross-sectional configuration example) of the inkjet head 4 along the line IV-IV shown in FIG. 2. Further, FIG. 5 is a diagram schematically showing a planar configuration example (an X-Y planar configuration example) of the inkjet head 4 on the upper surface side of a cover plate 413 (described later) shown in FIG. 3 and FIG. 4. FIG. 6 is a diagram schematically showing a planar configuration example (an X-Y planar configuration example) in the vicinity of an end part along the Y-axis direction in an actuator plate 412 (described later) shown in FIG. 3 and FIG. 4.

It should be noted that in FIG. 3 through FIG. 6, out of ejection channels C1*e*, C2*e* described later and nozzle holes H1, H2 described later, the ejection channel C1*e* and the nozzle hole H1 disposed so as to correspond to a nozzle array An1 described later are illustrated as a representative for the sake of convenience. In other words, the ejection channel C2*e* and the nozzle hole H2 disposed so as to correspond to a nozzle array An2 described later are provided with substantially the same configurations, and are therefore omitted from the illustration.

The inkjet heads 4 according to the present embodiment are each an inkjet head of a so-called side-shoot type for ejecting the ink 9 from a central part in an extending direction (the Y-axis direction) of a plurality of channels (a plurality of channels C1 and a plurality of channels C2) in a head chip 41 described later. Further, the inkjet heads 4 are each an inkjet head of a circulation type which uses the circulation channel 50 described above to thereby use the ink 9 while circulating the ink 9 between the inkjet head 4 and the ink tank 3.

As shown in FIG. 3 and FIG. 4, the inkjet heads 4 are each provided with the head chip 41. Further, the inkjet heads 4 are each provided with a circuit board and flexible printed circuit board (FPC) as a control mechanism (a mechanism for controlling the operation of the head chip 41) not shown.

The circuit board is a board for mounting a drive circuit (an electric circuit) for driving the head chip 41. The flexible printed circuit board is a board for electrically connecting the drive circuit on the circuit board and drive electrodes Ed described later in the head chip 41 to each other. It should be noted that it is arranged that such flexible printed circuit board is provided with a plurality of extraction electrodes as printed wiring.

As shown in FIG. 3 and FIG. 4, the head chip 41 is a member for jetting the ink 9 along the Z-axis direction, and is configured using a variety of types of plates. Specifically, as shown in FIG. 3 and FIG. 4, the head chip 41 is mainly provided with the nozzle plate (a jet hole plate) 411, the actuator plate 412, and the cover plate 413. The nozzle plate 411, the actuator plate 412, and the cover plate 413 are bonded to each other using, for example, an adhesive, and are stacked on one another in this order along the Z-axis direction. It should be noted that the description will hereinafter be presented with the cover plate 413 side along the Z-axis direction referred to as an upper side, and the nozzle plate 411 side referred to as a lower side.

(Nozzle Plate 411)

The nozzle plate 411 is formed of a film member made of polyimide or the like having a thickness of, for example, about 50 μm, and is bonded to a lower surface of the actuator plate 412 as shown in FIG. 3 and FIG. 4. It should be noted that the constituent material of the nozzle plate 411 is not limited to the resin material such as polyimide, but can also be, for example, a metal material.

Further, as shown in FIG. 2, the nozzle plate 411 is provided with two nozzle arrays (the nozzle arrays An1, An2) each extending along the X-axis direction. These nozzle arrays An1, An2 are arranged at a predetermined distance along the Y-axis direction. As described above, the inkjet head 4 (the head chip 41) in the present embodiment is formed as a two-row type inkjet head (head chip).

Although described later in detail, the nozzle array An1 has a plurality of nozzle holes H1 formed side by side along the X-axis direction at predetermined intervals. These nozzle holes H1 each penetrate the nozzle plate 411 along the thickness direction of the nozzle plate 411 (the Z-axis direction), and are individually communicated with the respective ejection channels C1*e* in the actuator plate 412. described later as shown in, for example, FIG. 3 and FIG. 4. Further, the formation pitch along the X-axis direction in the nozzle holes H1 is arranged to be the same (the same pitch) as the formation pitch along the X-axis direction in the ejection channels C1*e*. Although described later in detail, it is arranged that the ink 9 supplied from the inside of the ejection channel C1*e* is ejected (jetted) from each of the nozzle holes H1 in such a nozzle array An1.

Although described later in detail, the nozzle array An2 similarly has a plurality of nozzle holes H2 formed side by side along the X-axis direction at predetermined intervals. These nozzle holes H2 each penetrate the nozzle plate 411 along the thickness direction of the nozzle plate 411, and are individually communicated with the respective ejection channels C2*e* in the actuator plate 412 described later. Further, the formation pitch along the X-axis direction in the nozzle holes H2 is arranged to be the same as the formation pitch along the X-axis direction in the ejection channels C2*e*. Although described later in detail, it is arranged that the ink 9 supplied from the inside of the ejection channel C2*e* is also ejected from each of the nozzle holes H2 in such a nozzle array An2.

Further, as shown in FIG. 2, the nozzle holes H1 in the nozzle array An1 and the nozzle holes 112 in the nozzle array An2 are arranged in a staggered manner along the X-axis direction. Therefore, in each of the inkjet heads 4 according to the present embodiment, the nozzle holes H1 in the nozzle array An1 and the nozzle holes H2 in the nozzle array An2 are arranged in a staggered manner (in a staggered arrangement). It should be noted that such nozzle holes H1, H2 each have a tapered through hole gradually decreasing in diameter in a downward direction (see FIG. 3 and FIG. 4).

Here, as shown in FIG. 2, in the nozzle plate 411 in the present embodiment, out of the plurality of nozzle holes H1 in the nozzle array An1, the nozzle holes H1 adjacent to each other along the X-axis direction are arranged so as to be shifted from each other along the extending direction (the Y-axis direction) of the ejection channels C1*e*. In other words, the whole of the plurality of nozzle holes H1 in the nozzle array An1 is arranged in a staggered manner along the X-axis direction. Specifically, as shown in FIG. 2, it is arranged that the plurality of nozzle holes H1 in the nozzle array An1 includes a plurality of nozzle holes H11 belonging to a nozzle array An11 extending along the X-axis direction and a plurality of nozzle holes H12 belonging to a nozzle array An12 extending along the X-axis direction. Further, each of the nozzle holes H11 is arranged so as to be shifted toward the positive side (on a first supply slit Sin1 side described later) in the Y-axis direction with reference to a central position along the extending direction (the Y-axis direction) of the ejection channels C1*e*. In contrast, each of the nozzle holes H12 is arranged so as to be shifted toward the negative side (on a first discharge slit Sout1 side described later) in the Y-axis direction with reference to the central position along the extending direction of the ejection channels C1*e*.

Similarly, as shown in FIG. 2, in the nozzle plate 411, out of the plurality of nozzle holes H2 in the nozzle array An2, the nozzle holes H2 adjacent to each other along the X-axis direction are arranged so as to be shifted from each other along the extending direction (the Y-axis direction) of the ejection channels C2*e*. In other words, the whole of the plurality of nozzle holes H2 in the nozzle array An2 is arranged in a staggered manner along the X-axis direction. Specifically, as shown in FIG. 2, it is arranged that the plurality of nozzle holes H2 in the nozzle array An2 includes a plurality of nozzle holes H21 belonging to a nozzle array An21 extending along the X-axis direction and a plurality of nozzle holes H22 belonging to a nozzle array An22 extending along the X-axis direction. Further, each of the nozzle holes H21 is arranged so as to be shifted toward the negative side (on a second supply slit side described later) in the Y-axis direction with reference to a central position along the extending direction (the Y-axis direction) of the ejection channels C2*e*. In contrast, each of the nozzle holes H22 is arranged so as to be shifted toward the positive side (on a second discharge slit side described later) in the Y-axis direction with reference to the central position along the extending direction of the ejection channels C2*e*.

It should be noted that the details of the arrangement configuration of such nozzle holes H1 (H11, H12), H2 (H21, H22) will be described later.

(Actuator Plate 412)

The actuator plate 412 is a plate formed of a piezoelectric material such as PLT (lead zirconate titanate). As shown in FIG. 3 and FIG. 4, the actuator plate 412 is constituted by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, a single (unique) piezoelectric substrate having the polarization direction set to one direction along the thickness direction (the Z-axis direction) (a so-called cantilever type).

Further, as shown in FIG. 2, the actuator plate 412 is provided with two channel rows (channel rows 421, 422) each extending along the X-axis direction. These channel rows 421, 422 are arranged at a predetermined distance along the Y-axis direction.

In such an actuator plate 412, as shown in FIG. 2, an ejection area (jetting area) of the ink 9 is disposed in a central part (the formation areas of the channel rows 421, 422) along the X-axis direction. On the other hand, in the actuator plate 412, a non-ejection area (non-jetting area) of the ink 9 is disposed in each of the both end parts (non-formation areas of the channel rows 421, 422) along the X-axis direction. The non-ejection areas are each located on the outer side along the X-axis direction with respect to the ejection area described above. It should be noted that the both end parts along the Y-axis direction in the actuator plate 412 each constitute a tail part 420 as shown in FIG. 2.

As shown in FIG. 2, the channel row 421 described above has the plurality of channels C1. As shown in FIG. 2, these channels C1 each extend along the Y-axis direction in the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view of the Z-X cross-sectional surface.

As shown in FIG. 2, the channel row 422 similarly has the plurality of channels C2 each extending along the Y-axis direction. As shown in FIG. 2, these channels C2 are arranged side by side so as to be parallel to each other at predetermined intervals along the X-axis direction. Each of the channels C2 is also partitioned with the drive walls Wd described above, and forms a groove section having a recessed shape in the cross-sectional view of the Z-X cross-sectional surface.

Here, as shown in FIG. 2 through FIG. 6, in the channels C1, there exist the ejection channels C1*e* (the ejection grooves) for ejecting the ink 9, and the dummy channels C1*d* (the non-ejection grooves) not ejecting the ink 9. Each of the ejection channels C1*e* is communicated with the nozzle hole H1 in the nozzle plate 411 on the one hand (see FIG. 3 and FIG. 4), but each of the dummy channels C1*d* is not communicated with the nozzle hole H1, and is covered with the upper surface of the nozzle plate 411 from below on the other hand.

The plurality of ejection channels C1*e* is disposed side by side so that the ejection channels C1*e* at least partially overlap each other along a predetermined direction (the X-axis direction), and in particular in the example shown in FIG. 2, the plurality of ejection channels C1*e* is disposed so as to entirely overlap each other along the X-axis direction. Thus, as shown in FIG. 2, it is arranged that the whole of the plurality of ejection channels C1*e* is arranged in a row along the X-axis direction. Similarly, the plurality of dummy channels C1*d* is arranged side by side along the X-axis direction, and in the example shown in FIG. 2, the whole of the plurality of dummy channels C1*d* is arranged in a row along the X-axis direction. Further, in the channel row 421, the ejection channels C1*e* and the dummy channels C1*d* described above are alternately arranged along the X-axis direction (see FIG. 2).

Further, as shown in FIG. 2 through FIG. 4, in the channels C2, there exist the ejection channels C2*e* (the ejection grooves) for ejecting the ink 9, and the dummy channels C2*d* (the non-ejection grooves) not ejecting the ink 9. Each of the ejection channels C2*e* is communicated with the nozzle hole H2 in the nozzle plate 411 on the one hand, but each of the dummy channels C2*d* is not communicated with the nozzle hole H2, and is covered with the upper surface of the nozzle plate 411 from below on the other hand (see FIG. 3 and FIG. 4).

The plurality of ejection channels C2*e* is disposed side by side so that the ejection channels C2*e* at least partially overlap each other along a predetermined direction (the X-axis direction), and in particular in the example shown in FIG. 2, the plurality of ejection channels C2*e* is disposed so as to entirely overlap each other along the X-axis direction. Thus, as shown in FIG. 2, it is arranged that the whole of the plurality of ejection channels C2*e* is arranged in a row along the X-axis direction. Similarly, the plurality of dummy channels C2*d* is arranged side by side along the X-axis direction, and in the example shown in FIG. 2, the whole of the plurality of dummy channels C2*d* is arranged in a row along the X-axis direction. Further, in the channel row 422, the ejection channels C2*e* and the dummy channels C2*d* described above are alternately arranged along the X-axis direction (see FIG. 2).

It should be noted that the ejection channels C1*e*, C2*e* described above each correspond to a specific example of an "ejection groove" in the present disclosure, and the dummy channels C1*d*, C2*d* each correspond to a specific example of a "non-ejection groove" in the present disclosure. Further, the X-axis direction corresponds to a specific example of a "predetermined direction" in the present disclosure, and the Y-axis direction corresponds to a specific example of an "extending direction of the ejection groove" in the present disclosure.

Here, as shown in FIG. 2 through FIG. 4, the ejection channel C1*e* in the channel row 421 and the dummy channel C2*d* in the channel row 422 are arranged in alignment with each other along the extending direction (the Y-axis direction) of the ejection channel C1*e* and the dummy channel C2*d*. Further, as shown in FIG. 2, the dummy channel C1*d* in the channel row 421 and the ejection channel C2*e* in the channel row 422 are arranged in alignment with each other along the extending direction (the Y-axis direction) of the dummy channel C1*d* and the ejection channel C2*e*.

Further, as shown in, for example, FIG. 4, the ejection channels C1*e* each have arc-like side surfaces with which the cross-sectional area of each of the ejection channels C1*e* gradually decreases in a direction from the cover plate 413 side (upper side) toward the nozzle plate 411 side (lower side). Similarly, the ejection channels C2*e* each have arc-like side surfaces with which the cross-sectional area of each of the ejection channels C2*e* gradually decreases in the direction from the cover plate 413 side toward the nozzle plate 411 side. It should be noted that it is arranged that the arc-like side surfaces of such ejection channels C1*e*, C2*e* are each formed by, for example, cutting work using a dicer.

It should be noted that the detailed configuration in the vicinity of the ejection channel C1*e* (and the vicinity of the ejection channel C2*e*) shown in FIG. 3 and FIG. 4 will be described later.

Further, as shown in FIG. 3, FIG. 4, and FIG. 6, drive electrodes Ed extending along the Y-axis direction are respectively disposed on inner side surfaces opposed to each other along the X-axis direction in each of the drive walls Wd described above. As the drive electrodes Ed, there exist common electrodes Edc disposed on inner side surfaces facing the ejection channels C1*e*, C2*e*, and individual electrodes (active electrodes) Eda disposed on the inner side surfaces facing the dummy channels C1*d*, C2*d*. It should be noted that the drive electrodes Ed (the common electrodes Edc and the active electrodes Eda) described above are each formed in the entire area in the depth direction (the Z-axis direction) on the inner side surface of the drive wall Wd (see FIG. 3 and FIG. 4).

The pair of common electrodes Edc opposed to each other in the same ejection channel C1*e* (or the same ejection channel C2*e*) are electrically connected to each other in a common terminal (a common interconnection) not shown. Further, the pair of individual electrodes Eda opposed to each other in the same dummy channel C1*d* (or the same dummy channel C2*d*) are electrically separated from each other. In contrast, the pair of individual electrodes Eda opposed to each other via the ejection channel C1*e* (or the ejection channel C2*e*) are electrically connected to each other in an individual terminal (an individual interconnection) not shown.

Here, in the tail part 420 (in the vicinity of an end part along the Y-axis direction in the actuator plate 412) described above, there is mounted the flexible printed circuit board described above for electrically connecting the drive electrodes Ed and the circuit board described above to each other. Interconnection patterns (not shown) provided to the flexible printed circuit board are electrically connected to the common interconnections and the individual interconnections described above. Thus, it is arranged that a drive voltage is applied to each of the drive electrodes Ed from the drive circuit on the circuit board described above via the flexible printed circuit board.

Further, in the tail parts 420 in the actuator plate 412, an end part along the extending direction (the Y-axis direction) of each of the dummy channels C1*d*, C2*d* has the following configuration.

That is, first, in each of the dummy channels C1*d*, C2*d*, one side along the extending direction thereof has an arc-like side surface with which the cross-sectional area of each of the dummy channels C1*d*, C2*d* gradually decreases in a direction toward the nozzle plate 411 (see FIG. 3 and FIG. 4). It should be noted that it is arranged that the arc-like side surfaces in such dummy channels C1*d*, C2*d* are each formed by, for example, the cutting work with the dicer similarly to the arc-like side surfaces in the ejection channels C1*e*, C2*e* described above. In contrast, in each of the dummy channels C1*d*, C2*d*, the other side (on the tail part 420 side) along the extending direction thereof opens up to an end part along the Y-axis direction in the actuator plate 412 (see the symbol P2 indicated by the dotted lines in FIG. 3, FIG. 4, and FIG. 6). Further, as shown in, for example, FIG. 3, FIG. 4, and FIG. 6, it is arranged that each of the individual electrodes Eda disposed so as to be opposed to each other on the both side surfaces along the X-axis direction in each of the dummy channels C1*d*, C2*d* also extends up to the end part along the Y-axis direction in the actuator plate 412.

It should be noted that although described later in detail, working slits SL shown in FIG. 6 are each a slit formed along the Y-axis direction so as to separate the individual electrode Eda and the common electrode Edc on the surface of the actuator plate 412 from each other, and are formed in, for example, the following manner. That is, these working slits SL are each what is formed by, for example, predetermined laser processing when forming the actuator plate 412. Further, the individual electrodes Eda and the common electrodes Edc respectively include individual electrode pads Pda and common electrode pads Pdc (see FIG. 6) as pad parts which are respectively connected electrically to these electrodes, and at the same time, electrically connected to the flexible printed circuit board. Further, it is arranged that a groove D (see FIG. 6) located between the common electrode pads Pdc and the individual electrode pads Pda and separating these pads from each other is formed by the cutting work with the dicer after the predetermined laser processing described above.

(Cover Plate 413)

As shown in FIG. 3 through FIG. 5, the cover plate 413 is disposed so as to close the channels C1, C2 (the channel rows 421, 122) in the actuator plate 412. Specifically, the cover plate 413 is bonded to the upper surface of the actuator plate 412, and has a plate-like structure.

As shown in FIG. 3 through FIG. 5, the cover plate 413 is provided with a pair of entrance side common flow channels Rin1, Rin2, a pair of exit side common flow channels Rout1, Rout2, and wall parts W1, W2.

The wall part W1 is disposed so as to cover above the ejection channels C1*e* and the dummy channels C1*d*, and the wall part W2 is disposed so as to cover above the ejection channels C2*e* and the dummy channels C2*d* (see FIG. 3 and FIG. 4).

The entrance side common flow channels Rin1, Rin2 and the exit side common flow channels Rout1, Rout2 each extend along the X-axis direction, and are arranged side by side so as to be parallel to each other at predetermined distance along the X-axis direction as shown in, for example, FIG. 5. Among the above, the entrance side common flow channel Rin1 and the exit side common flow channel Rout1 are each formed in an area corresponding to the channel row 421 (the plurality of channels C1) in the actuator plate 412 (see FIG. 3 through FIG. 5). In contrast, the entrance side common flow channel Rin2 and the exit side common flow channel Rout2 are each formed in an area corresponding to the channel row 422 (the plurality of channels C2) in the actuator plate 412 (see FIG. 3 and FIG. 4).

It should be noted that these entrance side common flow channels Rin1, Rin2 each correspond to a specific example of a "first common flow channel" in the present disclosure. Further, the exit side common flow channels Rout1, Rout2 each correspond to a specific example of a "second common flow channel" in the present disclosure.

The entrance side common flow channel Rin1 is formed in the vicinity of an inner end part along the Y-axis direction in each of the channels C1, and forms a groove section having a recessed shape (see FIG. 3 through FIG. 5), In areas corresponding respectively to the ejection channels C1*e* in the entrance side common flow channel Rin1, there are respectively formed first supply slits Sin1 penetrating the cover plate 413 along the thickness direction (the Z-axis direction) of the cover plate 413 (see FIG. 3 through FIG. 5). Similarly, the entrance side common flow channel Rin2 is formed in the vicinity of an inner end part along the Y-axis direction in each of the channels C2, and forms a groove section having a recessed shape (see FIG. 3 and FIG. 4). In areas corresponding respectively to the ejection channels C2*e* in the entrance side common flow channel Rin2, there are also formed second supply slits (not shown) penetrating the cover plate 413 along the thickness direction of the cover plate 413, respectively.

It should be noted that the first supply slits Sin1 and the second supply slits each correspond to a specific example of a "first through hole" in the present disclosure.

The exit side common flow channel Rout1 is formed in the vicinity of an outer end part along the Y-axis direction in each of the channels C1, and forms a groove section having a recessed shape (see FIG. 3 through FIG. 5). In areas corresponding respectively to the ejection channels C1*e* in the exit side common flow channel Rout1, there are respectively formed first discharge slits Sout1 penetrating the cover plate 413 along the thickness direction of the cover plate 413 (see FIG. 3 through FIG. 5). Similarly, the exit side common flow channel Rout2 is formed in the vicinity of an outer end part along the Y-axis direction in each of the channels C2, and forms a groove section having a recessed shape (see FIG. 3 and FIG. 4). In areas corresponding respectively to the ejection channels C2*e* in the exit side common flow channel Rout2, there are also formed second discharge slits (not shown) penetrating the cover plate 413 along the thickness direction of the cover plate 413, respectively.

It should be noted that the first discharge slits Sout1 and the second discharge slits each correspond to a specific example of a "second through hole" in the present disclosure.

Here, as shown in, for example, FIG. 5, the first supply slit Sin1 and the first discharge slit Sout1 in each of the ejection channels C1*e* described above form a first slit pair Sp1. In the first slit pair Sp1, the first supply slit Sin1 and the first discharge slit Sout1 are disposed side by side along the extending direction (the Y-axis direction) of the ejection channel C1*e*. Similarly, the second supply slit and the second discharge slit in each of the ejection channels C2*e* form a second slit pair (not shown). In the second slit pair, the second supply slit and the second discharge slit are disposed side by side along the extending direction (the Y-axis direction) of the ejection channel C2*e*.

It should be noted that the first slit pair Sp1 and the second slit pair each correspond to a specific example of a "through hole pair" in the present disclosure.

In such a manner, it is arranged that the entrance side common flow channel Rin1 and the exit side common flow channel Rout1 are communicated with each of the ejection channels C1*e* via the first supply slit Sin1 and the first discharge slit Sout1, respectively (see FIG. 3 through FIG. 5). In other words, the entrance side common flow channel Rin1 is a common flow channel communicated with each of the first supply slits Sin1 of the respective first slit pairs Sp1 described above, and the exit side common flow channel Rout1 forms a common flow channel communicated with each of the first discharge slits Sout1 of the respective first slit pairs Sp1 (see FIG. 5). Further, the first supply slit Sin1 and the first discharge slit Sout1 each form a through hole through which the ink 9 flows to and from the ejection channel C1*e*. In particular, as indicated by the dotted arrows in FIG. 3 and FIG. 4, the first supply slit Sin1 is a through hole for making the ink 9 inflow into the ejection channel C1*e*, and the first discharge slit Sout1 is a through hole for making the ink 9 outflow from the inside of the ejection channel C1*e*. In contrast, neither the entrance side common flow channel Rin1 nor the exit side common flow channel Rout1 is communicated with the dummy channels C1*d*. Specifically, each of the dummy channels C1*d* is arranged to be closed by bottom parts in the entrance side common flow channel Rin1 and the exit side common flow channel Rout1.

Similarly, it is arranged that the entrance side common flow channel Rin2 and the exit side common flow channel Rout2 are communicated with each of the ejection channels C2*e* via the second supply slit and the second discharge slit, respectively. In other words, the entrance side common flow channel Rin2 is a common flow channel communicated with each of the second supply slits of the respective second slit pairs described above, and the exit side common flow channel Rout2 forms a common flow channel communicated with each of the second discharge slits of the respective second slit pairs. Further, the second supply slit and the second discharge slit each form a through hole through which the ink 9 flows to and from the ejection channel C2*e*. In particular, the second supply slit is a through hole for making the ink 9 inflow into the ejection channel C2*e*, and the second discharge slit forms a through hole for making the ink 9 outflow from the inside of the ejection channel C2*e*. In contrast, neither the entrance side common flow channel Rin2 nor the exit side common flow channel Rout2 is communicated with the dummy channels C2*d* (see FIG. 3 and FIG. 4). Specifically, each of the dummy channels C2*d* is arranged to be closed by bottom parts in the entrance side common flow channel Rin2 and the exit side common flow channel Rout2 (see FIG. 3 and FIG. 4).

[C. Detailed Configuration Around Ejection Channels C1*e*, C2*e*]

Then, a detailed configuration of the nozzle holes H1, H2 and the cover plate 413 in the vicinity of the ejection channels C1*e*, C2*e* will be described with reference to FIG. 2 through FIG. 5.

First, in the head chip 41 according to the present embodiment, as described above, the plurality of nozzle holes H1 includes the two types of nozzle holes H11, H12, and at the same time, the plurality of nozzle holes 112 includes the two types of nozzle holes H21, H22 (see FIG. 2).

Here, a central position Pn11 of each of the nozzle holes H11 is disposed so as to be shifted toward the positive side (on the first supply slit Sin1 side) in the Y-axis direction with reference to a central position Pc1 (i.e., a central position along the Y-axis direction of the wall part W1) along the extending direction (the Y-axis direction) of the ejection channels C1*e* (see FIG. 3 and FIG. 5). Similarly, a central position of each of the nozzle holes H21 is disposed so as to be shifted toward the negative side (on the second supply slit side) in the Y-axis direction with reference to a central position (i.e., a central position along the Y-axis direction of the wall part W2) along the extending direction (the Y-axis direction) of the ejection channels C2*e* (see FIG. 2).

In contrast, the central position Pn12 of each of the nozzle holes H12 is disposed so as to be shifted toward the negative side (on the first discharge slit Sout1 side) in the Y-axis direction with reference to the central position Pc1 along the extending direction of the ejection channels C1*e* (see FIG. 4 and FIG. 5). Similarly, a central position of each of the nozzle holes H22 is disposed so as to be shifted toward the positive side (on the second discharge slit side) in the Y-axis direction with reference to a central position along the extending direction (the Y-axis direction) of the ejection channels C2*e* (see FIG. 2).

Therefore, in each of the ejection channels C1*e* (C1*e*1) communicated with the respective nozzle holes H11, the cross-sectional area (the cross-sectional area Sfin1 of the first entrance side flow channel) of the flow channel of the ink 9 in a part communicated with the first supply slit Sin1 is made smaller than the cross-sectional area (the cross-sectional area Sfout1 of the first exit side flow channel) of the flow channel of the ink 9 in a part communicated with the first discharge slit Sout1 (Sfin1<Sfout1; see FIG. 3). Similarly, in each of the ejection channels C2*e* communicated with the respective nozzle holes H21, the cross-sectional area (the cross-sectional area of the second entrance side flow channel) of the flow channel of the ink 9 in a part communicated with the second supply slit is made smaller than the cross-sectional area (the cross-sectional area of the second exit side flow channel) of the flow channel of the ink 9 in a part communicated with the second discharge slit (Sfin2<Sfout2).

In contrast, in each of the ejection channels C1*e* (C1*e*2) communicated with the respective nozzle holes H12, on the contrary, the cross-sectional area Sfout1 of the first exit side flow channel described above is made smaller than the cross-sectional area Sfin1 of the first entrance side flow channel described above (Sfout1<Sfin1; see FIG. 4). Similarly, in each of the ejection channels C2*e* communicated with the respective nozzle holes H22, on the contrary, the cross-sectional area Sfout2 of the second exit side flow channel described above is also made smaller than the cross-sectional area Sfin2 of the second entrance side flow channel described above (Sfout2<Sfin2).

Further, in the head chip 41, the length (a first pump length Lw1; see FIG. 3 and FIG. 4) in the extending direction (the Y-axis direction) of the ejection channel C1*e* corresponding to a distance between the first supply slit Sin1 and the first discharge slit Sout1 in the first slit pair Sp1 described above is made the same in all of the first slit pairs Sp1 (see FIG. 5). Similarly, the length (a second pump length) in the extending direction (the Y-axis direction) of the ejection channel C2*e* corresponding to a distance between the second supply slit and the second discharge slit in the second slit pair described above is also made the same in all of the second slit pairs.

Further, in the head chip 41, the magnitude relationship between the length of the first supply slit Sin1 in the Y-axis direction (a first supply slit length Lin1) and the length of the first discharge slit Sout1 in the Y-axis direction (a first discharge slit length Lout1) is alternately flipped between the first slit pairs Sp1 adjacent to each other along the X-axis direction (see FIG. 5). In other words, for example, when there is a magnitude relationship of (Lin1>Lout1) in a certain first slit pair Sp1, there is a magnitude relationship of (Lin1<Lout1) on the contrary in each of the first slit pairs Sp1 located on both sides of that first slit pair Sp1. Further, for example, when there is the magnitude relationship of (Lin1<Lout1) in a certain first slit pair Sp1, there is the magnitude relationship of (Lin1>Lout1) on the contrary in each of the first slit pairs Sp1 located on both sides of that first slit pair Sp1.

Similarly, a magnitude relationship between the length of the second supply slit in the Y-axis direction (a second supply slit length) and the length of the second discharge slit in the Y-axis direction (a second discharge slit length) is also alternately flipped in such a manner as described above between the second slit pairs adjacent to each other along the X-axis direction.

Further, in the head chip 41, the length of the entrance side common flow channel Rin1 in the Y-axis direction (the first entrance side flow channel width Win1) is made constant along the extending direction (the X-axis direction) of the entrance side common flow channel Rin1 (see FIG. 5). Further, the length of the exit side common flow channel Rout1 in the Y-axis direction (the first exit side flow channel width Wout1) is also made constant along the extending direction (the X-axis direction) of the exit side common flow channel Rout1 (see FIG. 5).

Similarly, the length of the entrance side common flow channel Rin2 in the Y-axis direction (the second entrance side flow channel width) is also made constant along the extending direction (the X-axis direction) of the entrance side common flow channel Rin2. Further, the length of the exit side common flow channel Rout2 in the Y-axis direction (the second exit side flow channel width) is also made constant along the extending direction (the X-axis direction) of the exit side common flow channel Rout2.

It should be noted that the first pump length Lw1 and the second pump length described above each correspond to a specific example of a "length of a wall part" in the present disclosure. Further, the first supply slit length Lin1 and the second supply slit length described above each correspond to a specific example of a "first opening length" in the present disclosure, and the first discharge slit length Lout1 and the second discharge slit length described above each correspond to a specific example of a "second opening length" in the present disclosure. Further, the first entrance side flow channel width Win1 and the second entrance side flow channel width described above each correspond to a specific example of a "first flow channel width" in the present disclosure, and the first exit side flow channel width Wout1 and the second exit side flow channel width described above each correspond to a specific example of a "second flow channel width" in the present disclosure.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation channel 50, respectively.

In such an initial state, when operating the printer 1, the grit rollers 21 in the carrying mechanisms 2*a*, 2*b* each rotate to thereby carry the recording paper P along the carrying direction d (the X-axis direction) between the grit rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Then, the detailed operation (a jet operation of the ink 9) in the inkjet head 4 will be described. Specifically, in this inkjet head 4 (side-shoot type), the jet operation of the ink 9 using the shear mode is performed in the following manner.

First, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 via the flexible printed circuit boards described above. Specifically, the drive circuit applies the drive voltage to the drive electrodes Ed disposed on the pair of drive walls Wd forming the ejection channel C1*e*, C2*e*. Thus, the pair of drive walls Wd each deform so as to protrude toward the dummy channel C1*d*, C2*d* adjacent to the ejection channel C1*e*, C2*e*.

Here, since the configuration of the actuator plate 412 is made to be the chevron type described above, by applying the drive voltage using the drive circuit described above, it results that the drive wall Wd makes a flexion deformation to have a V shape centering on an intermediate position in the depth direction in the drive wall Wd. Further, due to such a flexion deformation of the drive wall Wd, the ejection channel C1*e*, C2*e* deforms as if the ejection channel C1*e*, C2*e* bulges.

Incidentally, when the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force being exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the volume of the ejection channel C1*e*, C2*e* increases. Further, due to the increase in the volume of the ejection channel C1*e*, C2*e*, it results that the ink 9 retained in the entrance side common flow channel Rin1, Rin2 is induced into the ejection channel C1*e*, C2*e*.

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing (or the timing in the vicinity of the timing) at which the pressure wave has reached the nozzle hole H1, H2 of the nozzle plate 411. Thus, the drive walls Wd are restored from the state of the flexion deformation described above, and as a result, the volume of the ejection channel C1*e*, C2*e* having once increased is restored again.

In the process in which the volume of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3 and FIG. 4) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

(C. Circulation Operation of Ink 9)

Then, the circulation operation of the ink 9 via the circulation channel 50 will be described in detail with reference to FIG. 1, FIG. 3, and FIG. 4.

In the printer 1, the ink 9 is fed by the liquid feeding pump described above from the inside of the ink tank 3 to the inside of the flow channel 50*a*. Further, the ink 9 flowing through the flow channel 50*b* is fed by the liquid feeding pump described above to the inside of the ink tank 3.

On this occasion, in the inkjet head 1, the ink 9 flowing from the inside of the ink tank 3 via the flow channel 50*a* inflows into the entrance side common flow channels Rin1, Rin2. The ink 9 having been supplied to these entrance side common flow channels Rin1, Rin2 is supplied to the ejection channels C1*e*, C2*e* in the actuator plate 412 via the first supply slit Sin1 and the second supply slit, respectively (see FIG. 3 and FIG. 4).

Further, the ink 9 in the ejection channels C1*e*, C2*e* flows into the exit side common flow channels Rout1 Rout2 via the first discharge slit Sout1 and the second discharge slit, respectively (see FIG. 3 and FIG. 4). The ink 9 supplied to these exit side common flow channels Rout1, Rout2 is discharged to the flow channel 50*b* to thereby outflow from the inside of the inkjet head 4. Then, the ink 9 having been discharged to the flow channel 50*b* is returned to the inside of the ink tank 3 as a result. In such a manner, the circulation operation of the ink 9 via the circulation channel 50 is achieved.

Here, in the inkjet head of a type other than the circulation type, when using fast drying ink, there is a possibility that a local increase in viscosity or local solidification of the ink occurs due to drying of the ink in the vicinity of the nozzle hole, and as a result, a failure such as an ink ejection failure occurs. In contrast, in the inkjet heads 4 (the circulation type inkjet heads) according to the present embodiment, since the fresh ink 9 is always supplied to the vicinity of the nozzle holes H1, H2, the failure such as the ink ejection failure described above is avoided as a result.

(D. Functions/Advantages)

Then, functions and advantages in the inkjet head 4 according to the present embodiment will be described in detail in comparison with a comparative example.

(D-1. Comparative Example)

Figure 7:
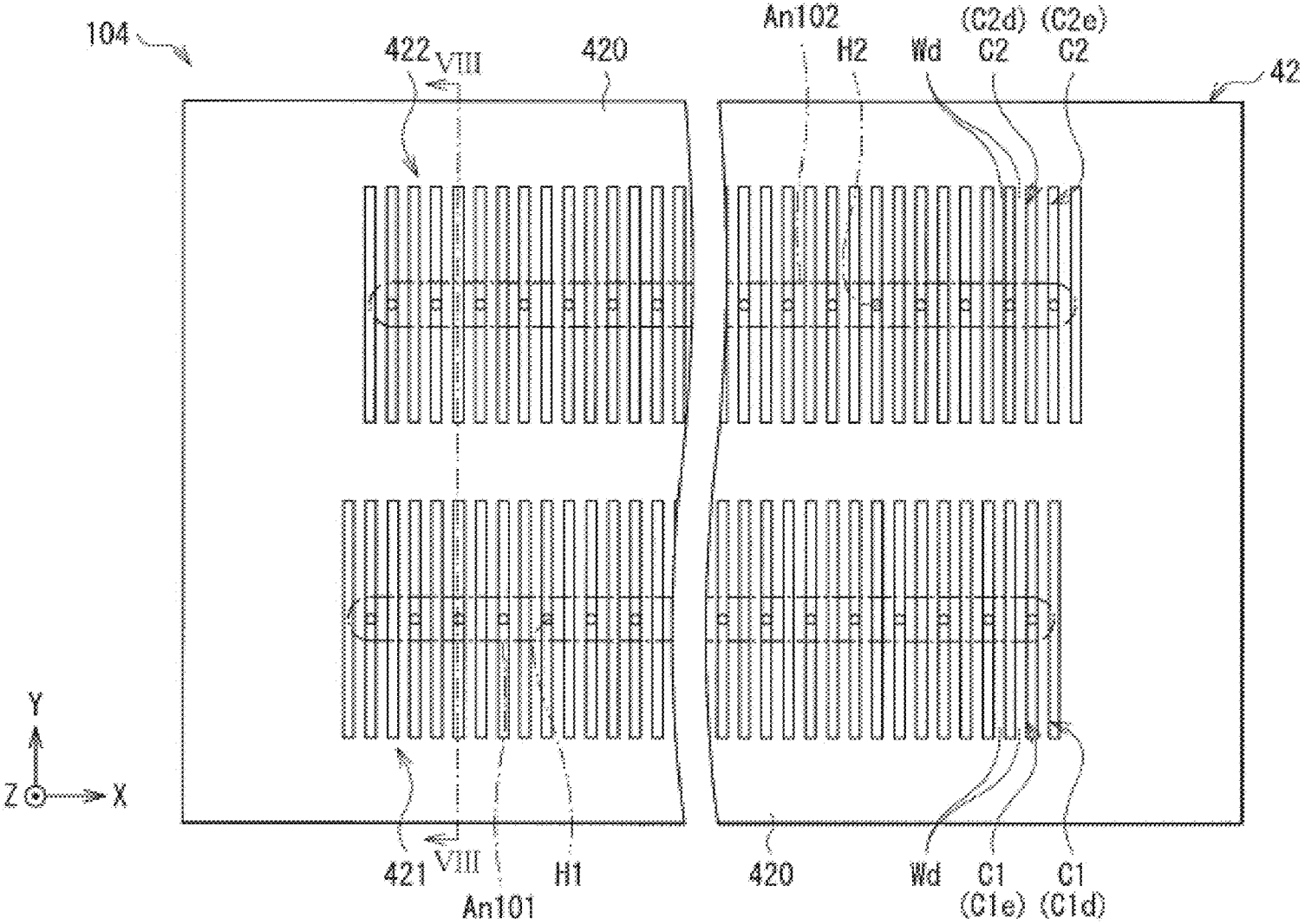
FIG. 7 is a schematic bottom view showing a configuration example of a liquid jet head according to a comparative example in the state in which a nozzle plate is detached.
Figure 8:
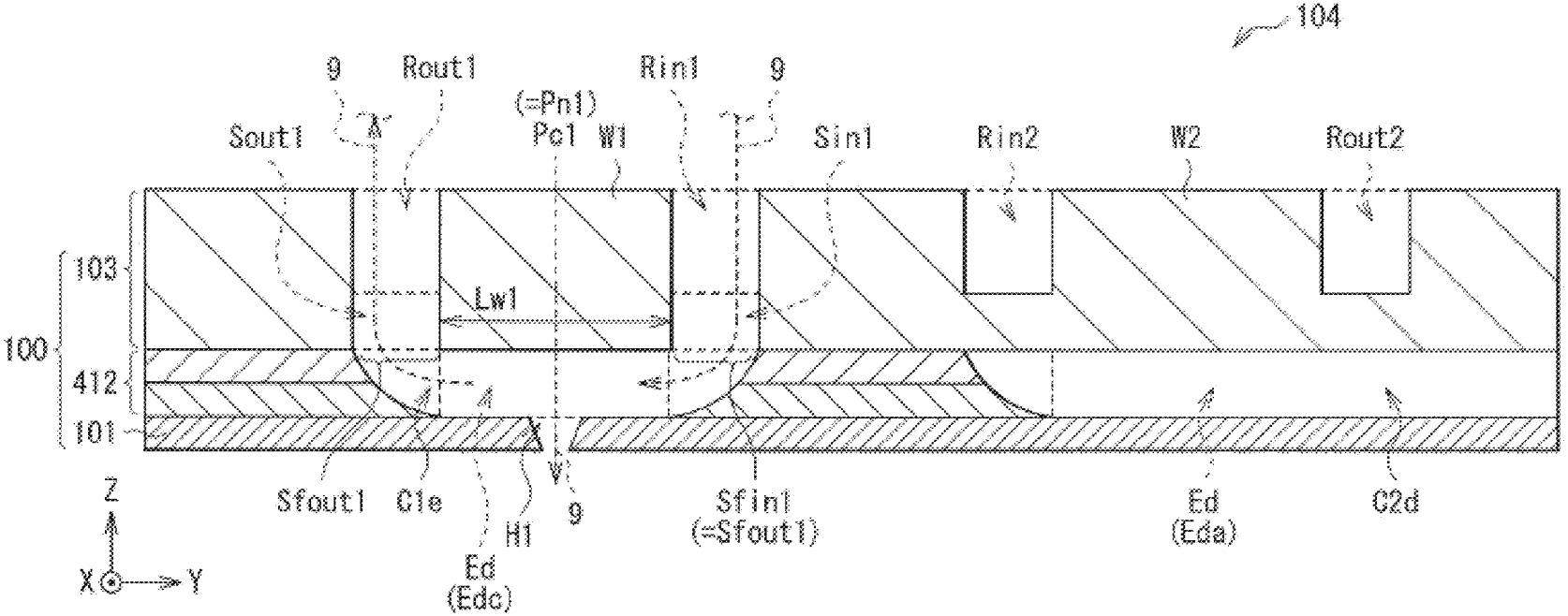
FIG. 8 is a schematic diagram showing a cross-sectional configuration example along the line VIII-VIII shown in FIG. 7.

FIG. 7 is a bottom view (an X-Y bottom view) schematically showing a configuration example of an inkjet head 104 according to a comparative example in the state in which a nozzle plate 101 (described later) according to the comparative example is detached. FIG. 8 is a diagram schematically showing a cross-sectional configuration example (a Y-Z cross-sectional configuration example) of the inkjet head 104 according to the comparative example along the line VIII-VIII shown in FIG. 7.

As shown in FIG. 7 and FIG. 8, the inkjet head 104 (a head chip 100) according to the comparative example corresponds to what is made different in arrangement configuration of the nozzle holes H1, H2 in the inkjet head 4 (the head chip 41) according to the present embodiment.

Specifically, in the nozzle plate 101 according to the comparative example, unlike the nozzle plate 411 in the present embodiment, nozzle holes H1, H2 in respective nozzle arrays An101, An102 are each arranged in a row along the extending direction (the X-axis direction) of the nozzle arrays An101, An102 (see FIG. 7). Specifically, unlike the case of the present embodiment described above, in the comparative example, it is arranged that the central position Pn1 of each of the nozzle holes H1 coincides with the central position Pc1 (i.e., the central position along the Y-axis direction of the wall part W1) along the extending direction (the Y-axis direction) of the ejection channel C1*e* (see FIG. 8). Similarly, in the comparative example, it is arranged that the central position of each of the nozzle holes 112 coincides with the central position (i.e., the central position along the Y-axis direction of the wall part W2) along the extending direction (the Y-axis direction) of the ejection channel C2*e*.

In such a comparative example, as described above, since the nozzle holes H1, H2 are each arranged in a row along the X-axis direction, when the distance between the nozzle holes H1 adjacent to each other and the distance between the nozzle holes H2 adjacent to each other decrease due to, for example, an increase in resolution of the print pixels, there is a possibility described below, for example. That is, in such a case, since the distance between the droplets which are jetted around the same time and flying toward the recording target medium (e.g., the recording paper P) decreases, the droplets flying between the nozzle holes H1, H2 and the recording target medium are locally concentrated in some cases. Thus, the influence (generation of an air current) on each of the droplets thus flying increases, and as a result, there is a possibility that a wood-effect unevenness in concentration occurs on the recording target medium to degrade the print image quality.

(D-2. Present Embodiment)

In contrast, in the inkjet head 4 (the head chip 41) according to the present embodiment, out of the plurality of nozzle holes H1, H2, the nozzle holes H1 adjacent to each other along the X-axis direction (and the nozzle holes H2 adjacent to each other along the X-axis direction) are arranged so as to be shifted from each other along the extending direction (the Y-axis direction) of the ejection channels C1*e*, C2*e*.

Thus, in the present embodiment, the distance between the nozzle holes H1 adjacent to each other (and the distance between the nozzle holes H2 adjacent to each other) becomes longer compared to, for example, (the comparative example described above) when the nozzle holes H1, H2 are each arranged in a row along the X-axis direction. Therefore, since the distance between the droplets which are jetted around the same time and flying toward the recording target medium (e.g., the recording paper P) increases, it is possible to relax the local concentration of the droplets flying between the nozzle holes H1, H2 and the recording target medium. Thus, in the present embodiment, the influence (the generation of the air current) on each of the droplets thus flying can be suppressed, and as a result, it is possible to suppress the occurrence of the wood-effect unevenness in concentration on the recording target medium (e.g., the recording paper P) described above compared to the comparative example described above. For the reason described above, in the inkjet head 4 (the head chip 41) according to the present embodiment, it becomes possible to improve the print image quality compared to, for example, the inkjet head 104 (the head chip 100) according to the comparative example described above.

Further, in particular in the present embodiment, since the whole of the plurality of ejection channels C1*e* (and the whole of the plurality of ejection channels C2*e*) is arranged inside the actuator plate 412 in a row along the X-axis direction, the following results. That is, the existing structure is maintained in the whole of the plurality of ejection channels C1*e* (and the whole of the plurality of ejection channels C2*e*) as a result. Therefore, it becomes possible to improve the print image quality while keeping (without increasing) the overall size (chip size) of the head chip 41.

Further, in the present embodiment, in the structure in which the nozzle holes H1 adjacent to each other (and the nozzle holes H2 adjacent to each other) along the X-axis direction are arranged so as to be shifted from each other along the Y-axis direction while maintaining the existing structure in the whole of the plurality of ejection channels C1*e* (and the whole of the plurality of ejection channels C2*e*) in such a manner as described above, it is also possible to achieve the following in substantially the same manner as in the existing structure. In other words, it is possible to uniform (commonalize) each of the first pump length Lw1 and the second pump length in all of the first slit pairs Sp1 and all of the second slit pairs. Thus, in the present embodiment, a variation in the ejection characteristics between the nozzle holes H1 adjacent to each other (and the nozzle holes H2 adjacent to each other) can be suppressed, and as a result, it becomes possible to further improve the print image quality. Further, in the present embodiment, the following results compared to the case of Modified Example 2 (when arranging the first supply slits Sin1 and the second supply slits in a staggered manner along the X-axis direction, and arranging the first discharge slits Sout1 and the second discharge slits in a staggered manner along the X-axis direction; see FIG. 12 described later) described later. That is, first, in the case of Modified Example 2, the whole of the plurality of ejection channels C1*e* (and the whole of the plurality of ejection channels C2*e*) is also arranged in a staggered manner along the X-axis direction (see FIG. 12). In contrast, in the present embodiment, since it is possible to form (process) the whole of the plurality of ejection channels C1*e* (and the whole of the plurality of ejection channels C2*e*) without adopting the staggered arrangement in substantially the same manner as the existing structure (see FIG. 5), the workability of the head chip 41 becomes good (it becomes possible to process the head chip 41 while maintaining the existing manufacturing process). Thus, in the present embodiment, it also becomes possible to realize to make the manufacturing process of the head chip 41 easy.

In addition, in the present embodiment, since the flow channel widths (the first entrance side flow channel width Win1 and the second entrance side flow channel width) in the entrance side common flow channels Rin1, Rin2, and the flow channel widths (the first exit side flow channel width Wout1 and the second exit side flow channel width) in the exit side common flow channels Rout1, Rout2 are each made constant along the extending direction (the X-axis direction) of each of the common flow channels, the following results. In other words, regarding the structure of each of the entrance side common flow channels Rin1, Rin2 and the exit side common flow channels Rout1, Rout2, it becomes possible to maintain the existing structure.

Further, in the present embodiment, since the one side along the extending direction (the Y-axis direction) in each of the dummy channels C1*d*, C2*d* forms the side surface described above, and at the same time, the other side along the extending direction thereof opens up to the end part along the Y-axis direction of the actuator plate 412, the following results. That is, as described above, in the structure in which the nozzle holes H1 adjacent to each other (and the nozzle holes H2 adjacent to each other) along the X-axis direction are arranged so as to be shifted from each other along the Y-axis direction, it becomes possible to arrange the nozzle holes H1, H2 in the nozzle plate 411 at high density without changing the overall size (the chip size) of the head chip 41. Further, since the other side described above in each of the dummy channels C1*d*, C2*d* opens up to the end part described above, it becomes possible to form the individual electrodes Eda to individually be disposed in the dummy channels C1*d*, C2*d* separately (in the state of being electrically isolated) from the common electrodes Ede to be disposed in the ejection channels C1*e*, C2*e* (see FIG. 6). For the reason described above, in the present embodiment, it becomes possible to realize to make the manufacturing process of the head chip 41 easy while achieving the reduction in chip size in the head chip 41.

2. Modified Examples

Subsequently, some modified examples (Modified Example 1 and Modified Example 2) of the embodiment described above will be described. It should be noted that the same constituents as those in the embodiment are denoted by the same reference symbols, and the description thereof will arbitrarily be omitted.

Modified Example 1

(Configuration)

Figure 9:
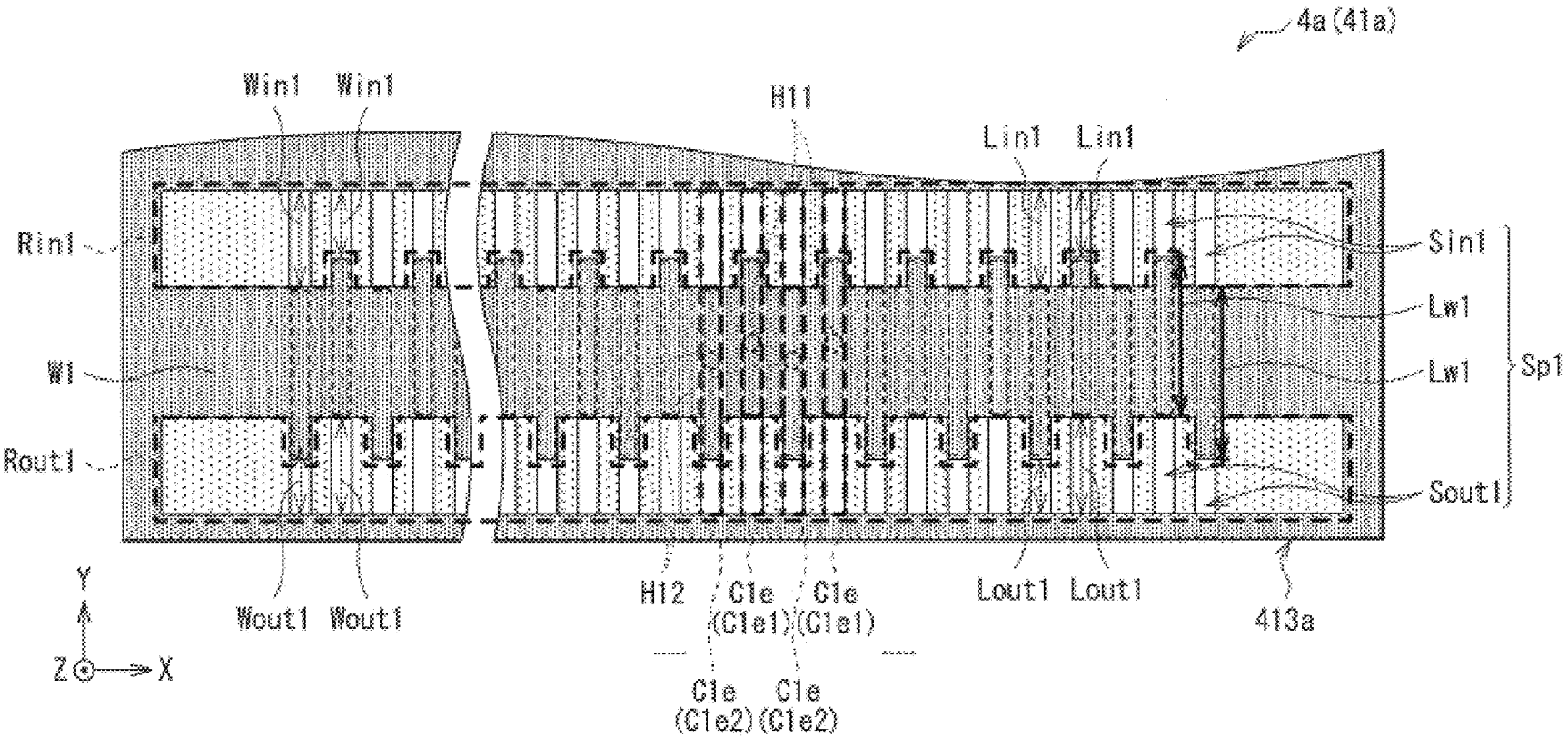
FIG. 9 is a schematic diagram showing a planar configuration example on the upper surface side of a cover plate in a liquid jet head according to Modified Example 1.

FIG. 9 is a diagram schematically showing a planar configuration example (an X-Y planar configuration example) on the upper surface side of a cover plate 413*a* related to Modified Example 1 in an inkjet head 4*a* according to Modified Example 1. Further, FIG. 10 and FIG. 11 each schematically show a cross-sectional configuration example (a Y-Z cross-sectional configuration example) in the inkjet head 4*a* according to Modified Example 1. Specifically, FIG. 10 shows the cross-sectional configuration example corresponding to FIG. 3 in the embodiment, and FIG. 11 shows the cross-sectional configuration example corresponding to FIG. 4 in the embodiment.

Figure 10:
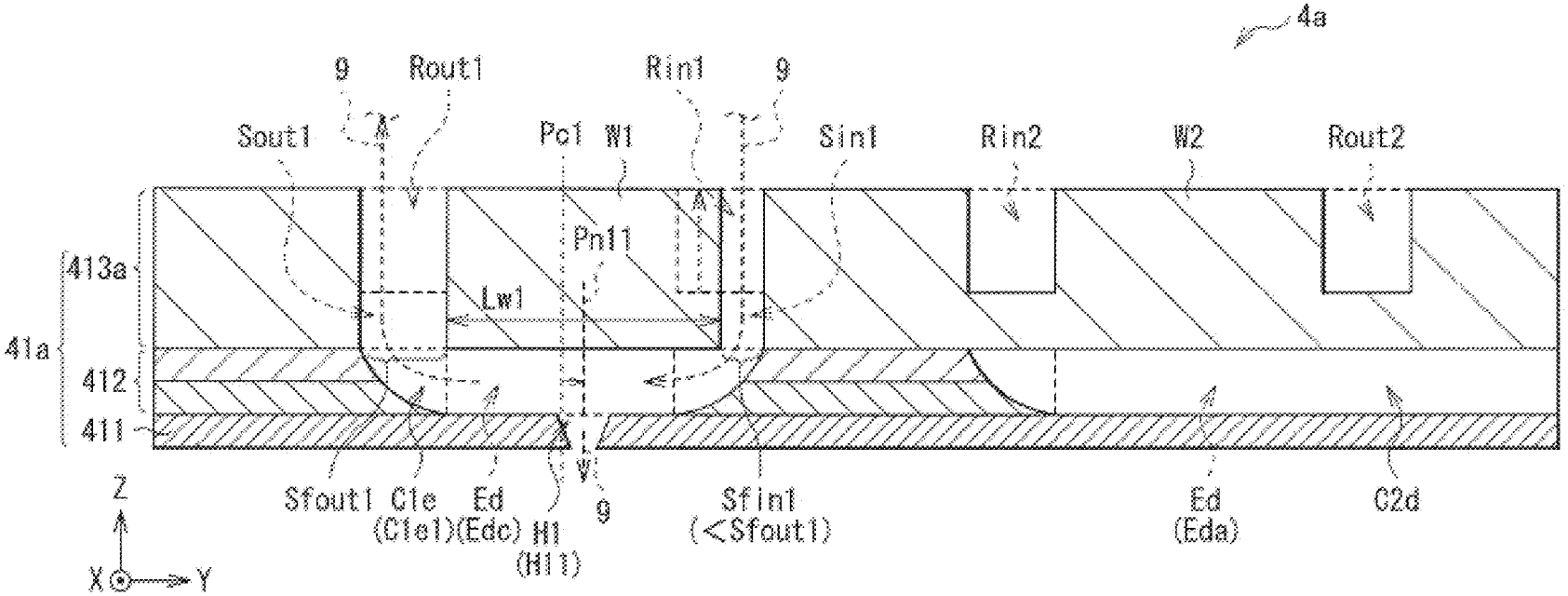
FIG. 10 is a schematic diagram showing a cross-sectional configuration example in the liquid jet head according to Modified Example 1.
Figure 11:
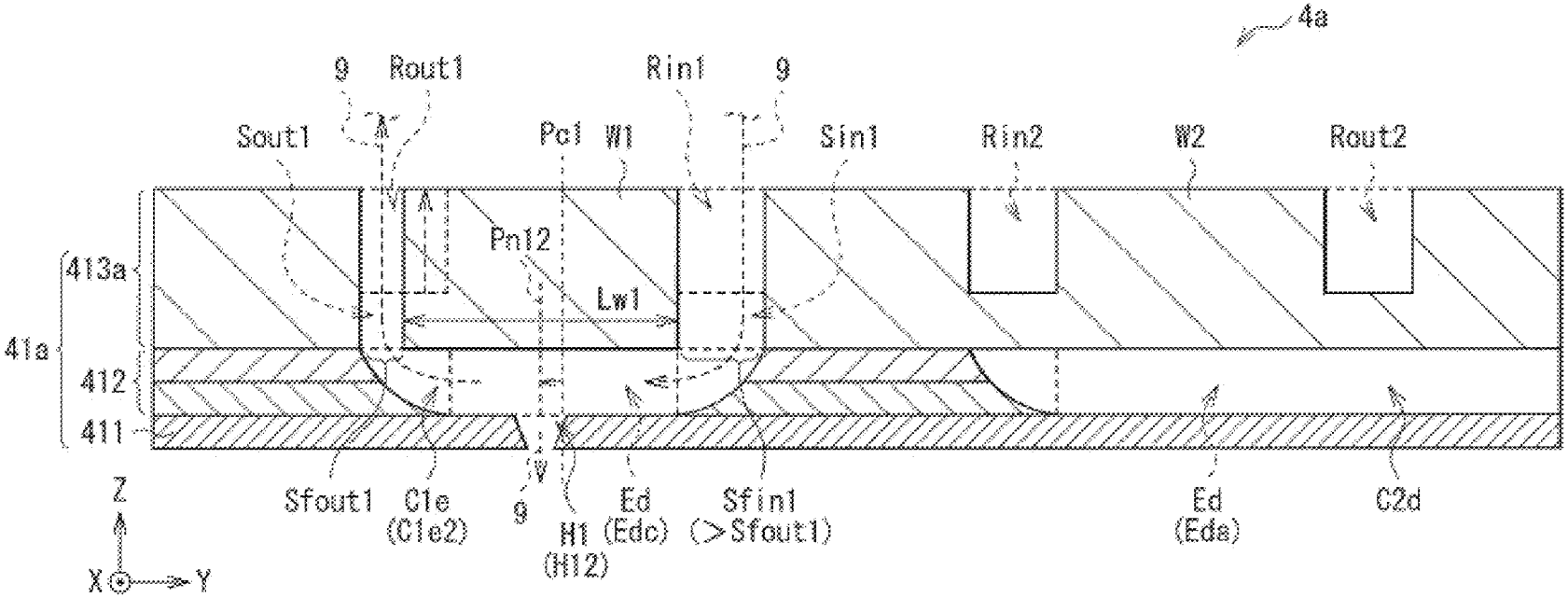
FIG. 11 is a schematic diagram showing another cross-sectional configuration example in the liquid jet head according to Modified Example 1.

As shown in FIG. 10 and FIG. 11, the inkjet head 4*a* according to Modified Example 1 corresponds to what is provided with the head chip 41*a* instead of the head chip 41 in the inkjet head 4 (see FIG. 3 and FIG. 4) according to the embodiment. Further, the head chip 41*a* according to Modified Example 1 corresponds to what is provided with a cover plate 413*a* described below instead of the cover plate 413 in the head chip 41, and the rest of the configuration is made basically the same (see FIG. 10 and FIG. 11). It should be noted that such an inkjet head 4*a* corresponds to a specific example of the "liquid jet head" in the present disclosure.

As shown in, for example, FIG. 9, in the cover plate 413*a* in Modified Example 1, unlike the cover plate 413 (see FIG. 5) in the embodiment, it is arranged that the flow channel widths (the first entrance side flow channel width Win1 and the second entrance side flow channel width) in the entrance side common flow channels Rin1, Rin2 change for each of the first slit pairs Sp1 and the second slit pairs along the X-axis direction. Specifically, each of the first entrance side flow channel width Win1 and the second entrance side flow channel width changes along the X-axis direction (see FIG. 9) in accordance with the alternate change of the first supply slit length Lin1 and the second supply slit length (the magnitude variation for each of the first slit pairs Sp1 and the second slit pairs) in the first slit pairs Sp1 adjacent to each other (and the second slit pairs adjacent to each other) along the X-axis direction.

Similarly, in this cover plate 413*a*, it is arranged that the flow channel widths (the first exit side flow channel width Win1 and the second exit side flow channel width) in the exit side common flow channels Rout1, Rout2 change along the X-axis direction for each of the first slit pairs Sp1 and the second slit pairs (see FIG. 9). Specifically, each of the first exit side flow channel width Wout1 and the second exit side flow channel width changes along the X-axis direction (see FIG. 9) in accordance with the alternate change of the first discharge slit length Lout1 and the second discharge slit length (the magnitude variation for each of the first slit pairs Sp1 and the second slit pairs) in the first slit pairs Sp1 adjacent to each other (and the second slit pairs adjacent to each other) along the X-axis direction.

Due to such a configuration, as indicated by the dotted arrows in, for example, FIG. 10 and FIG. 11, in this cover plate 413*a*, the thickness of one side surface part in the wall parts W1, W2 is made thicker compared to the cover plate 413 (see FIG. 3 and FIG. 4) in the embodiment. Specifically, as shown in, for example, FIG. 10, in the vicinity of the ejection channels C1*e*, C2*e* communicated with the nozzle holes H11, H21, the thickness of the side surface part on the first supply slit Sin1 and the second supply slit side in the wall parts W1, W2 is made thicker compared to the embodiment (see FIG. 3). In contrast, as shown in, for example, FIG. 11, in the vicinity of the ejection channels C1*e*, C2*e* communicated with the nozzle holes H12, H22, the thickness of the side surface part on the first discharge slit Sout1 and the second discharge slit side in the wall parts W2 is made thicker compared to the embodiment (see FIG. 4).

(Functions/Advantages)

Also in the inkjet head chip 4*a* (the head chip 41*a*) according to Modified Example 1 having such a configuration, it is possible to obtain basically the same advantages due to substantially the same function as that of the inkjet head 4 (the head chip 41) according to the embodiment.

Further, in particular in Modified Example 1, as described above, each of the first entrance side flow channel width Win1 and the second entrance side flow channel width changes along the X-axis direction in accordance with the alternate change in the first supply slit length Lin1 and the second supply slit length, and at the same time, each of the first exit side flow channel width Wout1 and the second exit side flow channel width changes along the X-axis direction in accordance with the alternate change in the first discharge slit length Lout1 and the second discharge slit length. Thus, in Modified Example 1, the following results compared to when each of the first entrance side flow channel width Win1, the second entrance side flow channel width, the first exit side flow channel width Wout1, and the second exit side flow channel width are made constant along the X-axis direction as in, for example, the embodiment (see FIG. 5). That is, due to the formation of the entrance side common flow channels Rin1, Rin2 and the exit side common flow channels Rout1, Rout2, the occurrence of the part (the one side surface part in the wall parts W1, W2 as described above) where the thickness is made thin in the cover plate 413*a* can be kept to a minimum as a result. As a result, in Modified Example 1, the mechanical strength in the entrance side common flow channels Rin1, Rin2 and the exit side common flow channels Rout1, Rout2 increases, and it is possible to prevent the crack from occurring compared to the case of the embodiment (see the cover plate 413 shown in FIG. 3 and FIG. 4). Therefore, in Modified Example 1, it becomes possible to enhance the reliability of the head chip 41*a* compared to the embodiment described above.

Modified Example 2

(Configuration)

Figure 12:
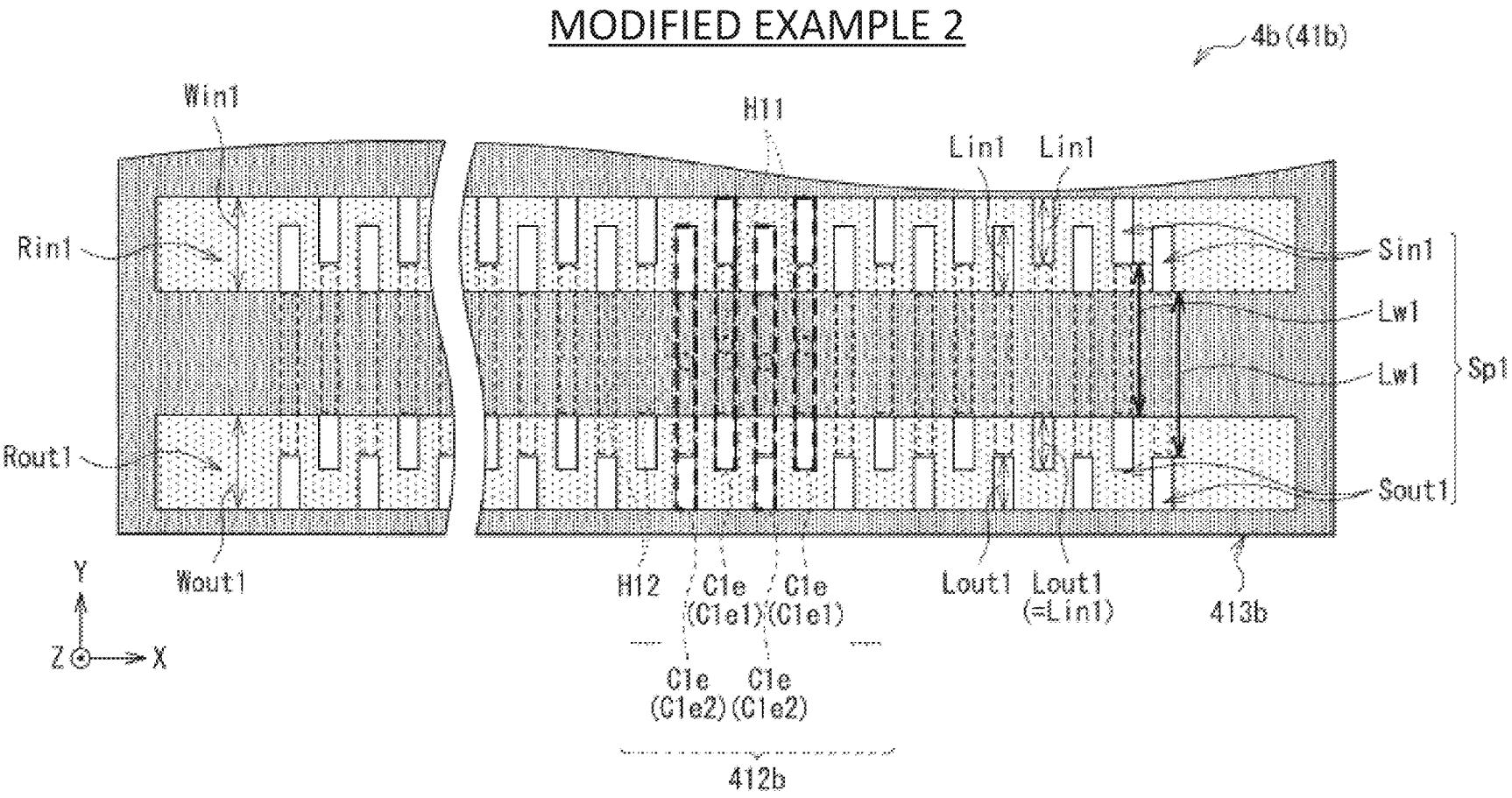
FIG. 12 is a schematic diagram showing a planar configuration example on the upper surface side of a cover plate in a liquid jet head according to Modified Example 2.

FIG. 12 is a diagram schematically showing a planar configuration example (an X-Y planar configuration example) on the upper surface side of a cover plate 413*b* related to Modified Example 2 in an inkjet head 4*b* according to Modified Example 2.

As shown in FIG. 12, the inkjet head 4*b* according to Modified Example 2 corresponds to what is provided with a head chip 41*b* instead of the head chip 41 in the inkjet head 4 (see FIG. 3 and FIG. 4) according to the embodiment.

Further, the head chip 41*b* according to Modified Example 2 corresponds to what is provided with an actuator plate 412*b* and a cover plate 413*a* described below instead of the actuator plate 412 and the cover plate 413 in the head chip 41, and the rest of the configuration is made basically the same (see FIG. 12). It should be noted that such an inkjet head 4*b* corresponds to a specific example of the "liquid jet head" in the present disclosure.

As shown in, for example, FIG. 12, in the actuator plate 412*b* in Modified Example 2, unlike the actuator plate 412 (see FIG. 5 and FIG. 9) in the embodiment and Modified Example 1, the arrangement configuration of the ejection channels C1*e*, C2*e* is made as follows. That is, in the actuator plate 412*b*, unlike the actuator plate 412, the ejection channels C1*e*, C2*e* are disposed so as to partially (not entirely) overlap each other along the X-axis direction. Thus, in the actuator plate 412*b*, the whole of the plurality of ejection channels C1*e* (and the whole of the plurality of ejection channels C2*e*) is arranged in a staggered manner (so as to be shifted from each other along the Y-axis direction) along the X-axis direction (see FIG. 12).

Further, in the cover plate 413*b* in Modified Example 2, the first pump length Lw1 and the second pump length described above are each made the same in all of the first slit pairs Sp1 and the second slit pairs (see FIG. 12) similarly to the cover plates 413, 413*a* (see FIG. 5 and FIG. 9) in the embodiment and Modified Example 1.

In contrast, unlike the cover plates 413, 413*a*, in the cover plate 413*b*, the first supply slit length Lin1 and the second supply slit length described above are made the same as the first discharge slit length Lout1 and the second discharge slit length described above, respectively (Lin1=Lout1, (second supply slit length)=(second discharge slit length)). Further, unlike the cover plates 413, 413*a*, in the cover plate 413*b*, the first supply slits Sin1, the second supply slits, the first discharge slits Sout1, and the second discharge slits are each arranged in a staggered manner along the extending directions (the X-axis direction) of the entrance side common flow channels Rin1, Ring, and the exit side common flow channels Rout1, Rout2, respectively (see FIG. 12).

(Functions/Advantages)

Also in the inkjet head 4*b* (the head chip 41*b*) according to Modified Example 2 having such a configuration, it is possible to obtain basically the same advantages due to substantially the same function as that of the inkjet head 4 (the head chip 41) according to the embodiment.

Further, in particular in Modified Example 2, as described above, since the nozzle holes H1 adjacent to each other (the nozzle holes H2 adjacent to each other) along the X-axis direction are disposed so as to be shifted from each other along the Y-axis direction, and at the same time, the whole of the plurality of ejection channels C1*e* (and the whole of the plurality of ejection channels C2*e*) is also arranged in a staggered manner along the X-axis direction, the following results. That is, the shift in the relative position along the extending direction (the Y-axis direction) of each of the ejection channels C1*e*, C2*e* between the nozzle holes H1, H2 corresponding to each of the ejection channels C1*e*, C2*e* becomes smaller compared to when the whole of the plurality of ejection channels C1*e* (and the whole of the plurality of ejection channels C2*e*) is arranged in a row along the X-axis direction as in, for example, the embodiment and Modified Example 1. In other words, when presenting the description with the example of the ejection channels C1*e* (C1*e*1, C1*e*2) shown in FIG. 12, the position in the Y-axis direction of the nozzle hole H11 corresponding to the ejection channel C1*e*1 and the position in the Y-axis direction of the nozzle hole H12 corresponding to the ejection channel C1*e*2 become difficult to be shifted in the ejection channels C1*e* adjacent to each other along the X-axis direction. In other words, it is possible to make the position of each of the nozzle holes H1 (H11, H12) approach to the vicinity of the center in the extending direction (the Y-axis direction) in each of the ejection channels C1*e* (C1*e*1, C1*e*2), and thus, it is possible to make the ejection characteristics in the nozzle holes H1 approximate to each other. It should be noted that this point is substantially the same as in the ejection channels C2*e* and the nozzle holes H2. Thus, in Modified Example 2, compared to the case of, for example, the embodiment and Modified Example 1, a variation in the ejection characteristics between the nozzle holes H1 adjacent to each other (the nozzle holes H2 adjacent to each other) in the X-axis direction is suppressed, and as a result, it becomes possible to further improve the print image quality.

Further, in Modified Example 2, as described above, since the first supply slit length Lin1 and the second supply slit length are made the same as the first discharge slit length Lout1 and the second discharge slit length, respectively, the following results compared to the case of, for example, the embodiment and Modified Example 1. That is, first, in the case of the embodiment and Modified Example 1 (see FIG. 5 and FIG. 9), as described above, the magnitude relationship between the first supply slit length Lin1 and the second supply slit length, and the first discharge slit length Lout1 and the second discharge slit length is alternately flipped between the first slit pairs Sp1 and the second slit pairs adjacent to each other in the X-axis direction. In contrast, in Modified Example 2, since the first supply slit length Lin1 and the second supply slit length are made the same as the first discharge slit length Lout1 and the second discharge slit length, a pressure difference between the nozzle holes H1 adjacent to each other (between the nozzle holes H2 adjacent to each other) in the X-axis direction becomes difficult to occur, and thus, the unevenness in the ejection speed of the ink 9 decreases. As a result, in Modified Example 2, it becomes possible to achieve a further improvement in the print image quality.

3. Other Modified Examples

The present disclosure is described hereinabove citing the embodiment and the modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer and the inkjet head, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment and so on described above, the description is presented citing the inkjet head 4 of the two-row type (having the two nozzle arrays An1, An2), but the example is not a limitation. Specifically, for example, it is also possible to adopt an inkjet head of a single-row type (having a single nozzle array), or an inkjet head of a multi-row type (having three or more nozzle arrays) with three or more rows (e.g., three rows or four rows).

Further, although in the embodiment and so on described above, there are specifically described the example (the example of the staggered arrangement) of the shifted arrangement of the nozzle holes H1 (H11, H12), H2 (H21, H22), the configuration example of the cover plate (the configuration example of the supply slits, the discharge slits, the entrance side common flow channels, the exit side common flow channels, and so on), and so on, these examples are not a limitation. Specifically, other configuration examples can be adopted as the shifted arrangement of the nozzle holes and the configuration of the cover plate.

Further, in the embodiment and so on described above, the description is presented citing when the ejection channels (the ejection grooves) and the dummy channels (the non-ejection grooves) each extend along the Y-axis direction (a direction perpendicular to the direction in which the channels are arranged side by side) in the actuator plate 412 as an example, but this example is not a limitation. Specifically, it is also possible to arrange that, for example, the ejection channels and the dummy channels extend along an oblique direction (a direction forming an angle with each of the X-axis direction and the Y-axis direction) in the actuator plate 412.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape. Further, the cross-sectional shape of each of the ejection channels C1*e*, C2*e* and the dummy channels C1*d*, C2*d* is described citing when being formed by the cutting work by the dicer to thereby have the side surface shaped like an arc (a curved surface) in the embodiment and so on described above as an example, but this example is not a limitation. Specifically, for example, it is possible to arrange that the cross-sectional shape of each of the ejection channels C1*e*, C2*e* and the dummy channels C1*d*, C2*d* becomes a variety of side surface shapes other than the arc-like shape by forming the channels using other processing method (e.g., etching or blast processing) than such cutting work with a dicer.

In addition, in the embodiment and so on described above, the description is presented citing the circulation type inkjet head for using the ink 9 while circulating the ink 9 between the ink tank and the inkjet head as an example, but the example is not a limitation. Specifically, in some cases, for example, it is also possible to apply the present disclosure to a non-circulation type inkjet head using the ink 9 without circulating the ink 9.

Further, as the structure of the inkjet head, it is possible to apply those of a variety of types. In other words, for example, in the embodiment and so on described above, the description is presented citing as an example a so-called side-shoot type inkjet head for ejecting the ink 9 from a central part in the extending direction of each of the ejection channels in the actuator plate. It should be noted that this example is not a limitation, but it is possible to apply the present disclosure to an inkjet head of another type.

Further, the type of the printer is not limited to the type described in the embodiment and so on described above, and it is possible to apply a variety of types such as an MEMS (Micro Electro-Mechanical Systems) type.

Further, the series of processes described in the above embodiment and so on can be arranged to be performed by hardware (a circuit), or can also be arranged to be performed by software (a program). When arranging that the series of processes is performed by the software, the software is constituted by a program group for making the computer perform the functions. The programs can be incorporated in advance in the computer described above and are then used, or can also be installed in the computer described above from a network or a recording medium and are then used.

Further, in the above embodiment and so on, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1> A head chip configured to jet a liquid comprising: an actuator plate having a plurality of ejection grooves; and a nozzle plate having a plurality of nozzle holes individually communicated with the plurality of ejection grooves, wherein the plurality of ejection grooves is arranged side by side so as to at least partially overlap each other along a predetermined direction, and the nozzle holes adjacent to each other along the predetermined direction of the plurality of nozzle holes are arranged so as to be shifted from each other along an extending direction of the ejection grooves in the nozzle plate.

<2> The head chip according to <1>, wherein a whole of the plurality of ejection grooves is arranged so as to overlap each other along the predetermined direction, and the whole of the plurality of ejection grooves is arranged in a row along the predetermined direction.

<3> The head chip according to <2>, further comprising a cover plate having a first through hole configured to make the liquid inflow into the ejection groove, a second through hole configured to make the liquid outflow from the ejection groove, and a wall part configured to cover the ejection groove, wherein a through hole pair constituted by the first through hole and the second through hole for each of the ejection grooves is arranged along the extending direction of the ejection groove, a length of the wall part along the extending direction of the ejection groove corresponding to a distance between the first through hole and the second through hole in the through hole pair is made same in all of the through hole pairs, and a magnitude relationship between a first opening length as a length of the first through hole along the extending direction of the ejection groove and a second opening length as a length of the second through hole along the extending direction of the ejection groove is alternately flipped between the through hole pairs adjacent to each other along the predetermined direction.

<4> The head chip according to <3>, wherein the cover plate further includes a first common flow channel extending along the predetermined direction, and communicated with each of the first through holes of the respective through hole pairs, and a second common flow channel extending along the predetermined direction, and communicated with each of the second through holes of the respective through hole pairs, a first flow channel width as a length of the first common flow channel along a direction perpendicular to the predetermined direction is made constant along the predetermined direction, and a second flow channel width as a length of the second common flow channel along a direction perpendicular to the predetermined direction is made constant along the predetermined direction.

<5> The head chip according to <3>, wherein the cover plate further includes a first common flow channel extending along the predetermined direction, and communicated with each of the first through holes of the respective through hole pairs, and a second common flow channel extending along the predetermined direction, and communicated with each of the second through holes of the respective through hole pairs, a first flow channel width as a length of the first common flow channel along a direction perpendicular to the predetermined direction changes along the predetermined direction in accordance with an alternate change in the first opening length in the through hole pairs adjacent to each other along the predetermined direction, and a second flow channel width as a length of the second common flow channel along a direction perpendicular to the predetermined direction changes along the predetermined direction in accordance with an alternate change in the second opening length in the through hole pairs adjacent to each other along the predetermined direction.

<6> The head chip according to <1>, wherein the plurality of ejection grooves is arranged so as to partially overlap each other along the predetermined direction, and the whole of the plurality of ejection grooves is arranged in a staggered manner along the predetermined direction.

<7> The head chip according to <6>, further comprising a cover plate having a first through hole configured to make the liquid inflow into the ejection groove, a second through hole configured to make the liquid outflow from the ejection groove, and a wall part configured to cover the ejection groove, wherein a through hole pair constituted by the first through hole and the second through hole for each of the ejection grooves is arranged along the extending direction of the ejection groove, a length of the wall part along the extending direction of the ejection groove corresponding to a distance between the first through hole and the second through hole in the through hole pair is made same in all of the through hole pairs, a first opening length as a length of the first through hole along the extending direction of the ejection groove and a second opening length as a length of the second through hole along the extending direction of the ejection groove are made same as each other, and the first through holes and the second through holes are each arranged in a staggered manner along the predetermined direction.

<8> The head chip according to any one of <1> to <7>, wherein the actuator plate further has a plurality of non-ejection grooves disposed side by side along the predetermined direction, the ejection grooves and the non-ejection grooves are alternately arranged along the predetermined direction, one side along an extending direction of the non-ejection groove in the non-ejection groove is provided with a side surface shaped like a curved surface with which a cross-sectional area of the non-ejection groove gradually decreases in a direction toward the nozzle plate, and the other side along the extending direction of the non-ejection groove in the non-ejection groove opens up to an end part along the extending direction of the non-ejection groove in the actuator plate.

<9> A liquid jet head comprising the head chip according to any one of <1> to <8>.

<10> A liquid jet recording device comprising the liquid jet head according to <9>.

What is claimed is:

1. A head chip configured to jet a liquid comprising:

an actuator plate having a plurality of ejection grooves; and a nozzle plate having a plurality of nozzle holes individually communicated with the plurality of ejection grooves, wherein the plurality of ejection grooves is arranged side by side so as to at least partially overlap each other along a predetermined direction, and the nozzle holes adjacent to each other along the predetermined direction of the plurality of nozzle holes are arranged so as to be shifted from each other along an extending direction of the ejection grooves in the nozzle plate, wherein the head chip further comprises a cover plate having:

a first through hole configured to make the liquid inflow into the ejection groove;

a second through hole configured to make the liquid outflow from the ejection groove; and a wall part configured to cover the ejection groove, wherein a through hole pair constituted by the first through hole and the second through hole for each of the ejection grooves is arranged along the extending direction of the ejection groove, a length of the wall part along the extending direction of the ejection groove corresponding to a distance between the first through hole and the second through hole in the through hole pair is made same in all of the through hole pairs, and a magnitude relationship between a first opening length as a length of the first through hole along the extending direction of the ejection groove and a second opening length as a length of the second through hole along the extending direction of the ejection groove is alternately flipped between the through hole pairs adjacent to each other along the predetermined direction.

2. The head chip according to claim 1, wherein:

a whole of the plurality of ejection grooves is arranged so as to overlap each other along the predetermined direction, and the whole of the plurality of ejection grooves is arranged in a row along the predetermined direction.

3. The head chip according to claim 1, wherein the cover plate further includes:

a first common flow channel extending along the predetermined direction, and communicated with each of the first through holes of the respective through hole pairs, and a second common flow channel extending along the predetermined direction, and communicated with each of the second through holes of the respective through hole pairs, a first flow channel width as a length of the first common flow channel along a direction perpendicular to the predetermined direction is made constant along the predetermined direction, and a second flow channel width as a length of the second common flow channel along a direction perpendicular to the predetermined direction is made constant along the predetermined direction.

4. The head chip according to claim 1, wherein the cover plate further includes:

a first common flow channel extending along the predetermined direction, and communicated with each of the first through holes of the respective through hole pairs, and a second common flow channel extending along the predetermined direction, and communicated with each of the second through holes of the respective through hole pairs, a first flow channel width as a length of the first common flow channel along a direction perpendicular to the predetermined direction changes along the predetermined direction in accordance with an alternate change in the first opening length in the through hole pairs adjacent to each other along the predetermined direction, and a second flow channel width as a length of the second common flow channel along a direction perpendicular to the predetermined direction changes along the predetermined direction in accordance with an alternate change in the second opening length in the through hole pairs adjacent to each other along the predetermined direction.

5. The head chip according to claim 1, wherein:

the plurality of ejection grooves is arranged so as to partially overlap each other along the predetermined direction, and the whole of the plurality of ejection grooves is arranged in a staggered manner along the predetermined direction.

6. The head chip according to claim 1, wherein:

the actuator plate further has a plurality of non-ejection grooves disposed side by side along the predetermined direction, the ejection grooves and the non-ejection grooves are alternately arranged along the predetermined direction, one side along an extending direction of the non-ejection groove in the non-ejection groove is provided with a side surface shaped like a curved surface with which a cross-sectional area of the non-ejection groove gradually decreases in a direction toward the nozzle plate, and the other side along the extending direction of the non-ejection groove in the non-ejection groove opens up to an end part along the extending direction of the non-ejection groove in the actuator plate.

7. A liquid jet head comprising the head chip according to claim 1.

8. A liquid jet recording device comprising the liquid jet head according to claim 7.

* * * * *